US011759969B2

(12) United States Patent
Pijpers

(10) Patent No.: US 11,759,969 B2
(45) Date of Patent: Sep. 19, 2023

(54) CONTAINER ASSEMBLY FOR COLLECTING PADS, COLLECTOR FOR RECEIVING AND COLLECTING PADS, PUNCHING DEVICE FOR MANUFACTURING PADS AND METHOD FOR COLLECTING PADS

(71) Applicant: VMI HOLLAND B.V., Epe (NL)

(72) Inventor: Teunis Pijpers, Epe (NL)

(73) Assignee: VMI HOLLAND B.V., Epe (NL)

( * ) Notice: Subject to any disclaimer, the term of this patent is extended or adjusted under 35 U.S.C. 154(b) by 0 days.

(21) Appl. No.: 17/620,460

(22) PCT Filed: Jun. 16, 2020

(86) PCT No.: PCT/NL2020/050384
§ 371 (c)(1),
(2) Date: Dec. 17, 2021

(87) PCT Pub. No.: WO2020/256542
PCT Pub. Date: Dec. 24, 2020

(65) Prior Publication Data

US 2022/0250271 A1 Aug. 11, 2022

(30) Foreign Application Priority Data

Jun. 17, 2019 (NL) ..... 2023325

(51) Int. Cl.
*B26F 1/40* (2006.01)
*B26D 7/18* (2006.01)
(Continued)

(52) U.S. Cl.
CPC ..... *B26F 1/40* (2013.01); *B26D 7/1818* (2013.01); *B26D 7/32* (2013.01); *B26F 1/3846* (2013.01);
(Continued)

(58) Field of Classification Search
CPC . B26F 1/40; B26F 1/3846; B26F 1/44; B26D 7/1818; B26D 7/32; B26D 7/00;
(Continued)

(56) References Cited

U.S. PATENT DOCUMENTS 4,817,365 A 4/1989 Yawberg et al.
5,234,313 A 8/1993 Delduca
(Continued)

FOREIGN PATENT DOCUMENTS

CN 1252037 A 5/2000
CN 103100590 A 5/2013
(Continued)

OTHER PUBLICATIONS

Search Report and Written Opinion from corresponding Dutch Application No. NL2023325, dated Apr. 10, 2020.
(Continued)

*Primary Examiner* — Jonathan G Riley
(74) *Attorney, Agent, or Firm* — WORKMAN NYDEGGER

(57) ABSTRACT

Container assembly for collecting pads, such as cosmetic pads or medical pads, wherein the container assembly comprises an elongate shell extending along a collecting axis parallel to a stacking direction and in a circumferential direction about the collecting axis, wherein the shell comprises a top side, a bottom side opposite to said top side in the stacking direction, wherein the shell is open at said top side for receiving the pads in said stacking direction and along said collecting axis, wherein the shell comprises a first shell segment and a second shell segment extending along said collecting axis between the top side and the bottom side and movable relative to one another in a clamping direction transverse to the stacking direction, wherein the second shell
(Continued)

segment is biased relative to and towards the first shell segment in said clamping direction.

23 Claims, 18 Drawing Sheets

(51) Int. Cl.
*B26D 7/32* (2006.01)
*B26F 1/38* (2006.01)
*B65H 29/46* (2006.01)
*B65H 31/10* (2006.01)

(52) U.S. Cl.
CPC ..... *B65H 29/46* (2013.01); *B65H 31/10* (2013.01); *B65H 2301/42172* (2013.01); *B65H 2701/1924* (2013.01)

(58) Field of Classification Search
CPC .. B26D 2007/0018; B26D 7/18; B65H 29/46; B65H 31/10; B65H 2301/42172; B65H 2701/1924
See application file for complete search history.

(56) References Cited

U.S. PATENT DOCUMENTS

| | | | | |
|---|---|---|---|---|
| 5,548,945 | A | 8/1996 | Nippes | |
| 5,675,963 | A * | 10/1997 | Nicholson | B65B 35/50 53/247 |
| 6,438,925 | B1 * | 8/2002 | Straub | B65B 5/108 53/244 |
| 10,618,766 | B2 | 4/2020 | Fridolfsson et al. | |
| 2016/0152364 | A1 * | 6/2016 | Kawoczka | B65B 35/50 53/435 |
| 2019/0152734 | A1 | 5/2019 | Fridolfsson et al. | |

FOREIGN PATENT DOCUMENTS

| | | | | |
|---|---|---|---|---|
| CN | 103568071 | A | 2/2014 | |
| CN | 109562903 | A | 4/2019 | |
| DE | 2130250 | A1 | 12/1972 | |
| DE | 4316363 | A1 | 11/1994 | |
| DE | 4342112 | C1 | 2/1995 | |
| EP | 9863100 | A1 | 9/1998 | |
| JP | H02502176 | A | 7/1990 | |
| JP | H11501891 | A | 2/1999 | |
| JP | 2001514608 | A | 9/2001 | |
| WO | 9628347 | A2 | 9/1996 | |
| WO | WO-9628347 | A2 * | 9/1996 | B26D 7/1818 |
| WO | 2009035316 | A1 | 3/2009 | |
| WO | WO-2009035316 | A1 * | 3/2009 | A61F 13/15577 |

OTHER PUBLICATIONS

International Search Report and Written Opinion from PCT Application No. PCT/NL2020/050384, dated Oct. 27, 2020.
Office Action from corresponding Japanese Application No. 2020-566879, dated Jan. 26, 2022.
Chinese Office Action in corresponding Chinese Patent Application No. 202010554279.3, dated Sep. 7, 2022.

* cited by examiner

CONTAINER ASSEMBLY FOR COLLECTING PADS, COLLECTOR FOR RECEIVING AND COLLECTING PADS, PUNCHING DEVICE FOR MANUFACTURING PADS AND METHOD FOR COLLECTING PADS

BACKGROUND

The invention relates to a container assembly for collecting pads, in particular hygienic pads or medical pads. The invention further relates to a carrier for receiving and collecting pads, said carrier comprising at least one container assembly according the present invention. The invention further relates to punching device for manufacturing pads, the punching device comprising a carrier according to the present invention. The invention further relates to a method for collecting pads using container assembly according to the present invention.

WO 2009/035316 A1 discloses a device for manufacturing cotton pads and a device for stacking cotton pads. The device for manufacturing cotton pads comprises a row of lower and upper dies displaceable toward each other, a supply roll with basic material for the cotton pads, and a basic material guide arranged in front of and a basic material guide arranged behind the row of dies. The device further comprises a row of ejectors which can protrude through the row of lower dies in order to thus press punched-out cotton pads into a housing. The row of ejectors is driven by a two-part drive rod, likewise arranged on a crankshaft.

The device for stacking cotton pads comprises an elongate tubular housing with a cross-section adapted to the form of the cotton pads, wherein the housing is open on both top and bottom side and is provided in lengthwise direction with a channel, an internal first rib arranged in the housing on the infeed side, an internal second rib arranged at a distance from the first rib, at least one displaceable removing finger which protrudes at least partially into the housing in lengthwise direction via the channel and has a starting position between the first and second rib.

SUMMARY OF THE INVENTION

A disadvantage of the known device for stacking cotton pads is that the cotton pads have to be pushed past the second rib to allow removal of the pads. This requires a relatively large stroke of the ejectors causing longer punching cycles. Moreover, due to the relatively large stroke, the pads may twist or tumble when pushed past the second rib, negatively influencing the overall product quality.

It is an object of the present invention to provide a container assembly for collecting pads, in particular hygienic pads or medical pads, a collector for receiving and collecting pads, a punching device for manufacturing pads and a method for collecting pads in which the pads can be collected more reliably and/or economically.

According to a first aspect, the invention provides a container assembly for collecting pads in a stacking direction, such as cosmetic pads or medical pads, wherein the container assembly comprises an elongate shell extending along a collecting axis parallel or substantially parallel to the stacking direction and extending in a circumferential direction about the collecting axis, wherein the shell comprises a top side and a bottom side opposite to said top side in the stacking direction, wherein the shell is open at said top side for receiving the pads in said stacking direction and along said collecting axis, wherein the shell comprises a first shell segment and a second shell segment extending along said collecting axis between the top side and the bottom side and movable relative to one another in a clamping direction transverse to the stacking direction, wherein the second shell segment is biased relative to the first shell segment to move towards said first shell segment in the clamping direction.

The pads do not have to be pushed or urged past an internal rib of the shell. Instead, the pads can be retained by the shell segments at the top side of the shell through the biasing. Consequently, when the container assembly is applied in a punching device, the stroke of the ejectors can be reduced and the pads can be punched more effectively and/or economically. Moreover, because of the biasing, said pads can be reliably retained in the shell regardless of the orientation of the collecting axis.

In an embodiment thereof, the second shell segment is rotatable from and towards the first shell segment about a shell rotation axis extending perpendicular to the stacking direction and the clamping direction. Hence, the first shell and the second shell can be moved with respect to each other in a plane extending along the stacking axis.

In a further embodiment thereof, the shell rotation axis is located at or near the bottom side of the shell. Hence, the second shell can be progressively moved inward from the bottom side to the top side. Consequently, the clamping of the pads can be stronger near the top side of the shell. Thus, the pads can be more reliably retained.

In a further embodiment thereof, the container comprises a shell biasing member for biasing the second shell segment towards the first shell segment, wherein the shell biasing member acts on the second shell segment at a shell biasing position spaced apart from the bottom side of the shell. Said shell biasing member can for example be a spring. The shell biasing member can generate a biasing moment for biasing the second shell segment towards the first shell segment.

In a further embodiment, the container assembly further comprises a shuttle to be positioned within the shell for supporting the pads received therein, wherein the shuttle is configured to abut the first shell segment and the second shell segment of the elongate shell, and wherein the shuttle is movable in the stacking direction along the collecting axis. Thus, the shuttle can move in the stacking direction with the pads to form a stack of pads by supporting the stack as it is being formed. The shuttle can prevent the received pads from rotating or tumbling. Moreover, the shuttle can counteract the bias of the second shell segment. Thus, deformation of the pads as a result of excessive inward movement of the shell can be reduced or prevented.

In a further embodiment thereof, the shuttle comprises a first part and a second part, wherein the first part and the second part are biased away from one another and towards the first shell segment and the second shell segment of the container assembly, respectively. Hence, the shuttle can be retained within the shell through frictional contact more reliably.

In a further embodiment thereof, the second shell segment is rotatable from and towards the first shell segment about a shell rotation axis extending perpendicular to the stacking direction and the clamping direction and located at or near the bottom side of the shell, wherein the second shell segment is biased towards the first shell segment by a first biasing moment about said shell rotation axis, wherein the first part and the second part of the shuttle are biased towards the first shell segment and the second shell segment, respectively, with a biasing force such that a second biasing moment, opposite to the first biasing moment, is exerted on the second shell segment, wherein the second biasing moment is dependent on the position of the shuttle along the collecting axis relative to the shell rotation axis. When multiple pads are subsequently stacked on top of the shuttle and the shuttle is moved towards the bottom side of the shell, the second biasing moment decreases progressively and becomes smaller than the first biasing moment, such that the difference between biasing moments results in a clamping force on the pads stacked on the shuttle. Said clamping force increases when the shuttle progresses along the collecting axis towards the bottom side of the shell. Consequently, a larger clamping force can be exerted on the pads when more pads have been collected in the shell. Hence, the pads can be retained more reliably. Moreover, no internal rib, as in the prior art, is required to retain the pads in the direction opposite to the stacking direction.

In a further embodiment thereof, the second biasing moment is smaller than the first biasing moment. Thus, the respective parts of the shuttle are pushed inward in the clamping direction. Consequently, when the pads are stacked on the shuttle, the shell can adapt to the size of the pads and exert a clamping force on said pads. When the shuttle is urged towards the bottom side of the shell by stacking the pads thereon, the second biasing moment decreases allowing the second shell segment to move inwards to exert a larger clamping force on the pads stacked on the shuttle.

In a further embodiment, the second biasing moment decreases when the shuttle is moved towards the bottom side of the shell. Thus, a maximum clamping force can be applied to the upper part of the received pads when the shell is full or substantially full.

In a further embodiment, when the shuttle is positioned at or near the top side of the shell, a first mutual distance in the clamping direction between the first shell segment and the second shell segment at the top side of the shell is smaller than a second mutual distance in the clamping direction between the first shell segment and the second shell segment at the bottom side of the shell. Hence, receiving of the first pad or pads can be facilitated.

In a further embodiment, when the shuttle is positioned at or near the bottom side of the shell, a first mutual distance in the clamping direction between the first shell segment and the second shell segment at the top side of the shell is smaller than a second mutual distance in the clamping direction between the first shell segment and the second shell segment at the bottom side of the shell. Hence, the collected pads can be retained effectively regardless of the orientation of the container assembly. This is especially advantageous when the container assembly is rotated to face top down in the direction of gravity.

In a further embodiment, the shell has a tubular or a substantially tubular shape. Preferably, the cross section of the tubular shape corresponds to the shape of the pads. A tubular shell provides a convenient shape for collecting and/or stacking pads.

According to a second aspect, the invention provides a collector for receiving and collecting pads from a punching device, wherein the collector comprises a carrier frame and a container assembly according to the present invention, wherein said container assembly is mounted to said carrier frame, wherein the second shell segment is movable relative to said carrier frame and biased relative to said carrier frame to move towards the first shell segment.

The collector comprises the container assembly according to the present invention and thus provides the same advantages as discussed above. Moreover, the collector may comprise multiple container assemblies, thus facilitating collecting multiple stacks of pads simultaneously.

In an embodiment thereof, the carrier frame comprises a first carrier plate facing in the stacking direction and a second carrier plate parallel to said first carrier plate and at a distance from said first carrier plate in the stacking direction, wherein the first shell segment and the second shell segment are, at the bottom side of the shell, mounted to the first carrier plate, and wherein the first shell segment and the second shell segment are, at a center region of the shell mounted to said second carrier plate. Hence, the carrier frame can securely hold one or more containers.

In a further embodiment thereof, the container assembly comprises a shell biasing member, wherein the second shell segment is hingedly connected to the first carrier plate, and wherein the second shell segment is connected to the second carrier plate via said shell biasing member for biasing the second shell segment towards the first shell segment. Said shell biasing member can for example be a spring, such as a leaf spring or a coil spring. The shell biasing member can generate a biasing moment for biasing the second shell segment towards the first shell segment.

In a further embodiment thereof, the collector further comprises a stop for limiting the movement of the second shell segment towards the first shell segment. Hence, a minimum distance between the first shell segment and the second shell segment can be predetermined. Said minimum distance can facilitate the insertion of the first pad or pads in the shell.

In a further embodiment, the first shell segment is rigidly connected to the first carrier plate and/or the second carrier plate. Hence, the first shell segment can be mounted to the carrier frame in a rigid manner. Thus the first shell segment can reliably be retained to the carrier frame in a fixed position.

In a further embodiment, the collector comprises an opener plate which is connected to the second shell segment for selectively moving said second shell segment relative to the first shell segment, wherein the opener plate is movable in a direction parallel to the first carrier plate. In other words, the opener plate can selectively open and/or close the container assemblies. The opening of the container assemblies may facilitate the insertion of the pads in said container assemblies. Additionally, friction between the pads and the container assemblies may be reduced. Consequently the container assembly is filled more homogeneously. After urging the pads in the respective container assemblies, the container assemblies can be closed to retain the pads. Thus, the stroke of the ejector may be further reduced, thus reducing cycle times as well.

According to a third aspect, the invention provides a punching device for manufacturing pads form a continuous web, the punching device comprising a collector according to the present invention, wherein the punching device further comprises a first die and a second die opposite to the first die in a punching direction, wherein the first die and the second die are movable relative to each other in said punching direction for punching the pads, wherein the first die comprises a first body and an ejector aperture extending through said first body in the punching direction, wherein the second die comprises a second body and a receiving aperture extending through said second body in the punching direction for receiving the punched pads, wherein the punching device further comprises an ejector which is movable in the punching direction relative to the first die through the ejector aperture and towards the receiving aperture of the second die for ejecting the punched pads into the receiving aperture of the second die, wherein the collector is mounted relative to the second die, such that the container assembly extends into the receiving aperture for receiving the punched pads at said receiving aperture.

The punching device comprises the collector and container assembly according to the present invention and, thus, has the same advantages as discussed above. Moreover, because the container assembly can clamp and retain the pads near the top side of the shell, a smaller stroke of the ejector can be sufficient to urge the pads into the shell. In particular, pads can be ejected directly into the container assembly. This is in contrast with the prior art in which the pads have to be pushed past a first internal rib to be retained by the collector. Hence, the pads can be collected more efficiently or economically.

In an embodiment thereof, the second body has a cutting edge extending circumferentially about said receiving aperture and facing the first die in the punching direction, and wherein the container assembly extends up to a distance of less than ten millimeters of said cutting edge in the punching direction, preferably up to a distance of less than five millimeters of said cutting edge. This allows an even smaller stroke of the ejector. Hence, the pads can be collected more efficiently or economically.

In a further embodiment thereof, the punching device further comprises a manipulator for removing the collector from the second die, wherein the manipulator is arranged to rotate or invert the collector into a position in which the top side is located below the bottom side of the shell. Thus, the collector can be arranged with the top side facing downwards when in the punching device or when removed from the punching device. In said position, the pads can be retained more reliably through the biasing.

In a further embodiment, the receiving opening is dimensioned for accommodating the container assembly with the first shell segment and the second shell segment extending parallel to each other. Hence, receiving of the first pad or pads can be facilitated.

According to a fourth aspect, the invention provides a method for collecting pads, such as cosmetic pads or medical pads, using a container assembly according to the present invention, wherein the method comprises the step of receiving a pad through the open top side of the shell, wherein, the first shell segment and the second shell segment are biased towards one another in the clamping direction. Hence, the received pad can be retained more reliably during at least a part of the urging of said pad towards the bottom side of the shell.

In an embodiment thereof, the second shell segment is pivotable towards first shell segment about a shell rotation axis near the bottom side of the shell and perpendicular to the stacking direction and the clamping direction, wherein the method further comprises the steps of:

providing a shuttle in the shell near the top side of said shell such that said shuttle is in abutment with both the first shell segment and the second shell segment, the shuttle comprising a first part and a second part, wherein the first part and the second part are biased away from one another and towards the first shell segment and the second shell segment of the container assembly, respectively, to exert a shell biasing moment on the second shell segment;

urging said pad in the stacking direction into a position in which the pad is supported by the shuttle in said stacking direction; and urging the shuttle and the pad supported thereon towards the bottom side of the shell, wherein, when the shuttle is urged towards the bottom side of the shell, the shell biasing moment exerted by the shuttle on the second shell segment decreases. Hence, the pads are supported in the stacking direction and tumbling or pivoting of said pads can be prevented more reliably.

In a further embodiment, when the pads are urged towards the bottom side of the shell, the first shell segment and the second shell segment are pivoted towards one another, such that a first mutual distance in the clamping direction between the first shell segment and the second shell segment at the top side of the shell is smaller than a second mutual distance in the clamping direction between the first shell segment and the second shell segment at the bottom side of the shell. Hence, the collected pads can be retained effectively regardless of the orientation of the container assembly. This is especially advantageous when the container assembly is rotated to face top down in the direction of gravity.

In a further advantageous embodiment, the method comprises a step in which the top side of the container assembly is directed downwards, wherein the pads received in the container assembly are retained in the container assembly during said step.

According to a fifth, unclaimed aspect, the invention relates to a punching device for punching pads, in particular hygienic pads or medical pads, from a continuous web, wherein the punching device comprises a first die and a second die opposite to the first die in a punching direction, wherein the first die and the second die are movable relative to each other in said punching direction for punching the pads, wherein the first die comprises a first body and an ejector aperture extending through said first body in the punching direction, wherein the second die comprises a second body and a receiving aperture extending through said second body in the punching direction for receiving the punched pads, wherein the punching device further comprises an ejector which is movable in the punching direction relative to the first die through the ejector aperture and towards the receiving aperture of the second die for ejecting the punched pads into the receiving aperture of the second die, wherein the punching device further comprises a drive assembly for driving the movements of the first die and the ejector assembly, wherein the drive assembly comprises a rotationally driven drive shaft rotatable in a rotation direction about a drive axis extending perpendicular to the punching direction, wherein the drive assembly further comprises a cam wheel for driving the movement of the first die, and a curve wheel for driving the movement of the ejector assembly, wherein the cam wheel and the curve wheel are arranged on said drive shaft and are co-rotational with said drive shaft in the rotation direction.

The drive shaft can thus drive the movements of both the ejector assembly and the first die. Hence, a separate drive for driving the ejector assembly can be omitted.

In an embodiment thereof, the cam wheel has a circular cross section and is arranged off center with respect to the drive shaft. In other words, the cam wheel acts as a crank shaft. Hence, the cam wheel can convert a rotational movement of the drive shaft into a translational movement of the first die in the punching direction. In particular, the cam wheel can convert the rotational movement of the drive shaft in a reciprocating translational movement of the first die.

In an further embodiment, the curve wheel has a curved circumference having a curve wheel radius in a radial direction perpendicular to the drive axis, wherein the curve wheel radius varies along the rotation direction between a first radius, a second radius larger than the first radius, and a third radius larger than the second radius. The first radius can correspond to an idle position of the ejectors. The second radius can correspond to a punching position of the ejectors, i.e. a position at or near the web. Thus, the ejectors can move together with the first die towards the web. The third radius can correspond to an ejection positon, i.e. a position in which the ejectors extend into the receiving aperture of the second die.

In a further embodiment thereof, the circumference comprises a first curve that extends in the rotation direction at the first radius, wherein the circumference further comprises a second curve, adjacent to the first curve in the rotation direction, that extends at the second radius, wherein the circumference further comprises a third curve, adjacent to the second curve in the rotation direction, that increases from the second radius to the third radius in the rotation direction, and wherein the circumference further comprises a fourth curve, extending between the third curve and the first curve, wherein the fourth curve decreases in the radial direction from the third radius to the first radius along the rotation direction. The curve wheel can, thus, urge the ejectors successively from the idle position towards the punching position and into the ejection position.

In an embodiment thereof, the third curve and the fourth curve each extend over less than ninety degrees in the rotation direction. Hence, the ejecting stroke, i.e. the stroke for ejecting the punched pads into the receiving aperture of the second die, can be shortened in time. Hence, the pads can be punched more effectively and/or economically.

According to a sixth, unclaimed aspect, the invention relates to a punching device for punching pads, in particular hygienic pads or medical pads, from a continuous web, wherein the punching device comprises a first die and a second die opposite to the first die in a punching direction, wherein the first die and the second die are movable relative to each other in said punching direction for punching the pads, wherein the punching device further comprises a drive assembly for driving the movement of the first die, wherein the drive assembly comprises a rotationally driven drive shaft rotatable in a rotation direction about a drive axis extending perpendicular to the punching direction, wherein the drive assembly further comprises a crank that extends between the drive shaft and the first die to convert a rotational movement of the drive shaft into a translational movement of the first die in the punching direction, wherein the punching device comprises a guide assembly which is connected to the first die for guiding said first die in the punching direction, wherein the guide assembly comprises a guide rail and two linear guides, wherein the guide rail and the two linear guides are movable relative to each other in the punching direction.

The guide assembly can direct the rotational movement of the crank shaft into the punching direction. Moreover, the two guides can counteract a moment force imparted on the first die by the crank. Hence, wear can be reduced.

In a preferred embodiment thereof, the guides are mounted to a base and the guide rail is mounted to the first die. Alternatively, the guide rail can be mounted to said base while mounting the guides to the first die.

In a further embodiment, the linear guides are guide shoes. Guide shoes can have smaller tolerances as compared to sliding bearings. Hence, moment forces imparted on the first die can be reduced further.

In a further embodiment, the drive assembly comprises a cam wheel arranged on the drive shaft and co-rotational with said drive shaft, wherein the cam wheel has a circular cross section and is arranged off center with respect to the drive shaft, and wherein the crank surrounds the cam wheel. Hence, the cam wheel can move the first die both towards and away from the second die.

In a further, preferred embodiment, the linear guides are arranged mutually in line in the punching direction. Alternatively, the linear guides can be arranged on respective sides of the drive shaft with respect to the vertical plane.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached schematic drawings, in which.

DETAILED DESCRIPTION OF THE INVENTION

Figure 1:
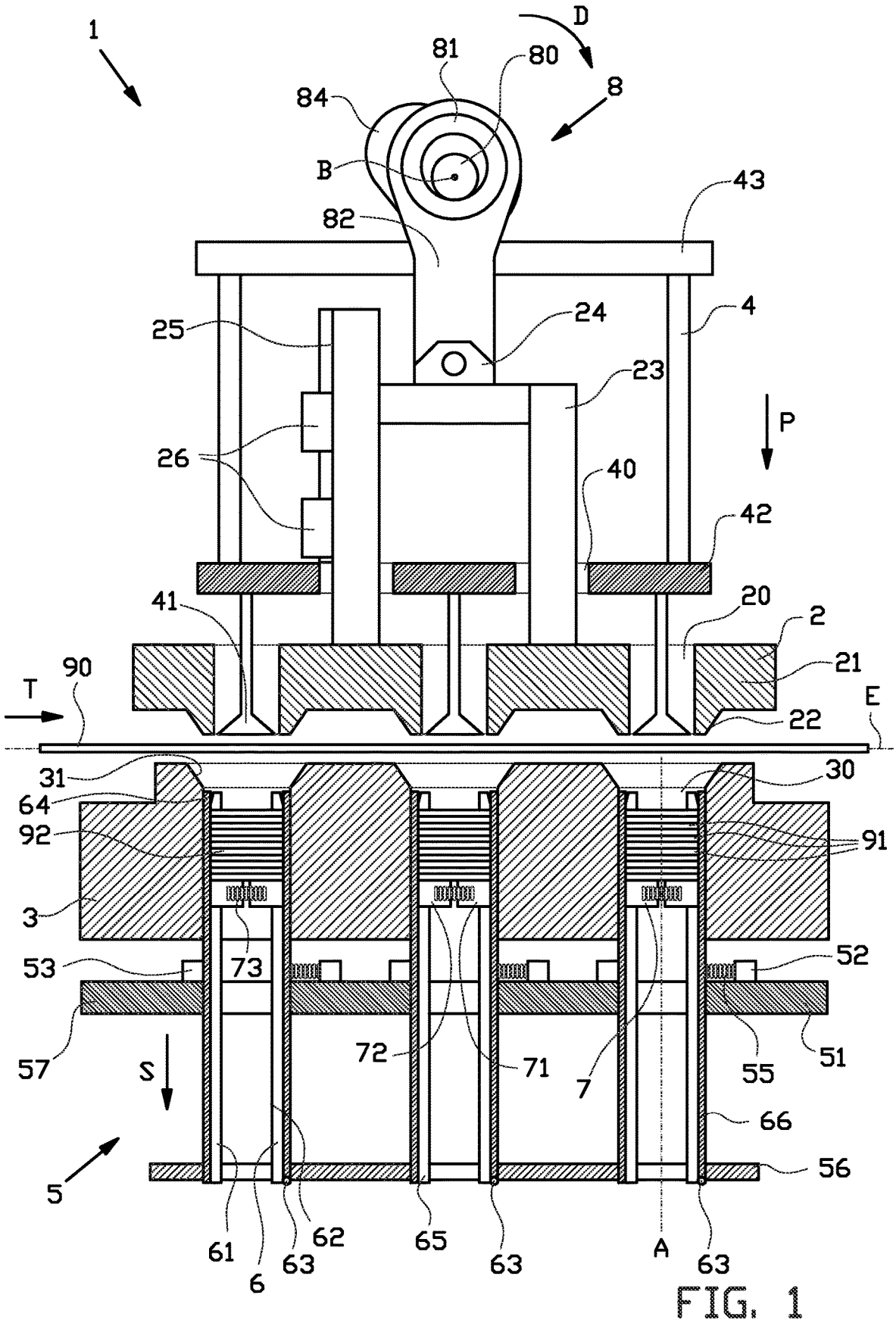
FIGS. 1, 3, 5 and 7 show section views of a punching device for punching pads according to the present invention in different operational states.

FIG. 1 shows a punching device 1 for punching pads 91, in particular hygienic pads or medical pads, from a continuous web 90 according to an exemplary embodiment of the present invention.

Said punching device 1 comprises a first die 2 and a second die 3 opposite to the first die 2 in a punching direction P. The web 90 is conveyed between the first die 2 and the second die 3 in a conveyance plane E facing in the punching direction P and in a transport direction T transverse to the punching direction P and in said conveyance plane E. The web 90 is conveyed in a manner known per se.

The first die 2 comprises a first die body 21 and a plurality of ejector apertures 20 extending through said first body 21 in the punching direction P. The first die 2 comprises a plurality of first cutting edges 22 facing towards the second die 3 and extending circumferentially about each one of the ejector apertures 20. Said ejector apertures 20 are cylindrical or substantially cylindrical. More particularly, the ejector apertures 20 have a circular or substantially circular cross section. However, it will be apparent to the person skilled in the art that other cross sections may be applied depending on the desired shape of the pads 91.

The second die 3 comprises a second body 31 and a plurality of receiving apertures 30 extending through said second body 31 in the punching direction P. Said receiving apertures 30 of the second die 3 are aligned with the ejector apertures 20 of the first die 2. The second die 3 comprises a plurality of second cutting edges 32 facing the first die 2 and extending circumferentially about each one of the receiving apertures 30. Said first cutting edges 22 and said second cutting edges 32 are arranged to cooperate for cutting the pads 91 from the web 90.

In this exemplary embodiment, the second die 3 is arranged stationary and the first die 2 is movable back and forth in the punching direction P relative to the second die 3. Alternatively, the second die 3 or both the first die 2 and the second die 3 may be movable back and forth in the punching direction P.

The punching device 1 further comprises an ejector assembly 4 which is movable relative to the first die 2 for ejecting the punched pads from said first die 2 into the receiving apertures 30 of the second die 3. The ejector assembly 4 comprises a plurality of ejectors 41 which extend through the ejector apertures 20 of the first die 2 and are movable relative to said first die 2 and relative to said second die 3. In particular, said ejectors 41 are movable in the punching direction P through the ejector apertures 20 and into the receiving apertures 30.

The punching device 1 further comprises a collector 5 for receiving and collecting the punched pads 91. The collector 5 comprises a plurality of container assemblies 6 which, in FIG. 1, extend within the receiving apertures 30 of the second die 3 for receiving the punched pads 91 in a stacking direction S. The collector 5 is arranged removably relative to said second die 3 for movement towards another station, e.g. a pad packing station. The collector 5 comprises a carrier frame 51 for mounting the container assemblies 6 thereon. The carrier frame 51 comprises a first carrier plate 56 facing in the stacking direction S and a second carrier plate 57 parallel to the first carrier plate 56 and at a distance from said first carrier plate 56.

The container assemblies 6 are arranged for collecting the punched pads 91 in the stacking direction S. When mounted relative to the second die 3, said stacking direction S is parallel to or substantially parallel to the punching direction P. The container assemblies 6 comprise an elongate shell 60 extending along a collecting axis A parallel or substantially parallel to the stacking direction S. The shell 60 extends circumferentially about the collecting axis A in a circumferential direction C. The shell 60 has a top side 64 and a bottom side 65 opposite to said top side 64 in the stacking direction S. Preferably, the shell 60 has a tubular or substantially tubular shape. In this particular embodiment, the cross section of the shell 60 corresponds to the shape of the pads 91. The shell 60 is open at its top side 64 for receiving the pads 91 punched between the first die 2 and the second die 3 in the stacking direction S and along the collecting axis A.

The shell 60 comprises a first shell segment 61 and a second shell segment 62 extending along the collecting axis A between the top side 64 and the bottom side 65 of the shell 60. The first shell segment 61 and the second shell segment 62 are movable relative to one another in a clamping direction K transverse to the stacking direction S. Preferably, said clamping direction K is perpendicular to the stacking direction S.

In the exemplary embodiment as shown in FIGS. 10A-10D, the first shell segment 61 and the second shell segment 62 are, at the bottom side 65 of the shell 60, mounted to the first carrier plate 56. The first shell segment 61 and the second shell segment 62 are mounted to the second carrier plate 57 at a position spaced apart from the bottom side 64 of the shell 60. The first shell segment 61 is arranged stationary within the collector 5. More particularly, the first shell segment 60 is, at the bottom side 65, rigidly connected to the first carrier plate 56 and, at a position spaced apart from the bottom side 65, rigidly connected to the second carrier plate 57.

The second shell segment 62 is hingedly attached to the first carrier plate 56 as to be rotatable from and towards the first shell segment 61 about a shell rotation axis 63 extending perpendicular to the stacking direction S and the clamping direction K. Said shell rotation axis 63 is located at or near the bottom side 65 of the shell 60.

The second shell segment 62 is biased relative to the first shell segment 61. In particular, the second shell segment 62 is biased towards the first shell segment 61 in the clamping direction K. The container assemblies 6 further comprise a shell biasing member 55 arranged at a shell biasing position 66 of the second shell segment 62 spaced apart from the bottom side 65 of the shell 60. In this particular embodiment, the shell biasing member 55 is connected to the second carrier plate 57 for biasing said second shell segment 62 towards the first shell segment 61. Preferably, said shell biasing member 55 is a spring element.

Figure 9:
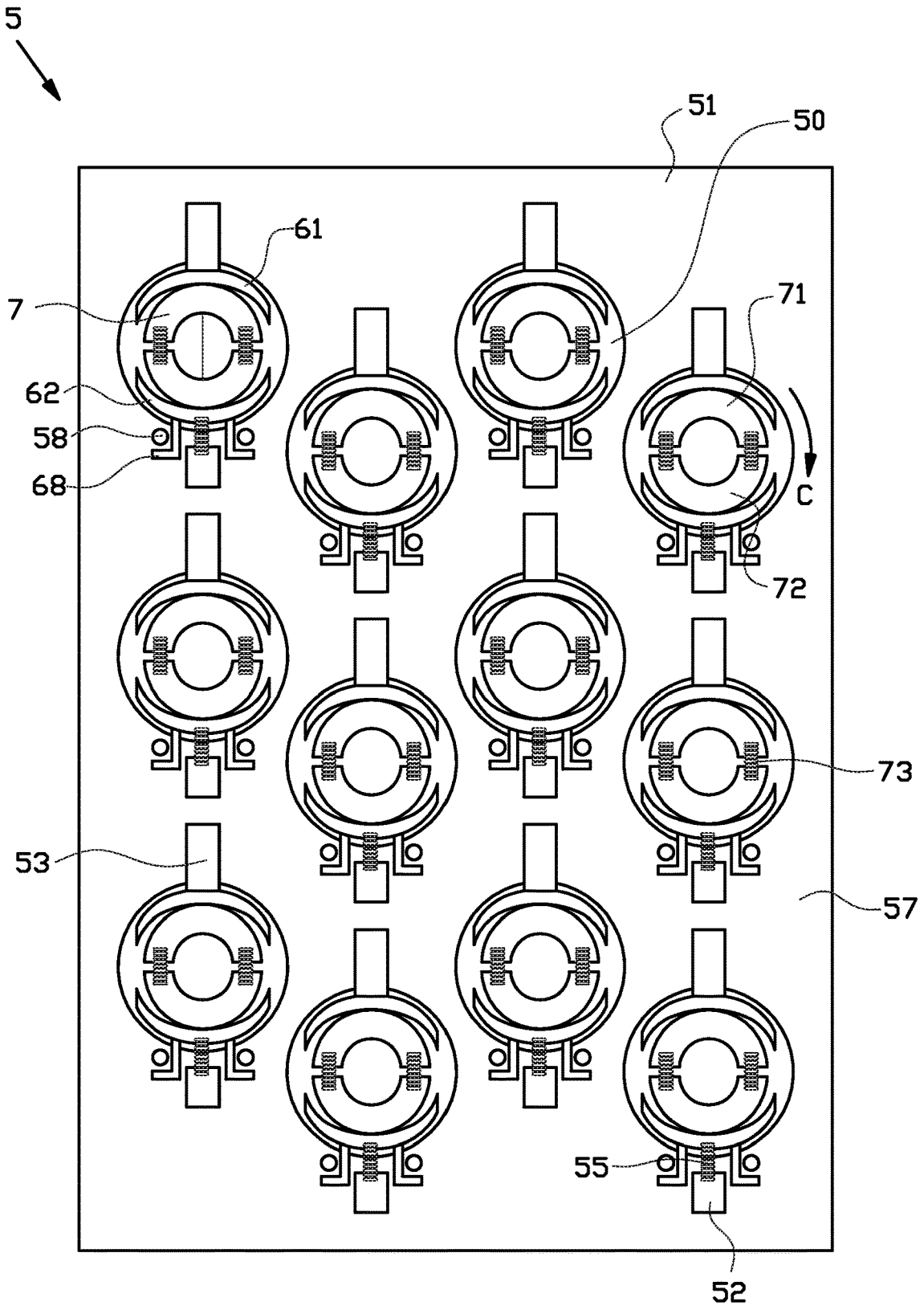
FIG. 9 shows a top view of a carrier assembly according to the present invention.

As is best shown in FIG. 9, the container assemblies 6 are each positioned within a frame aperture 50 in the second carrier plate 57. The container assemblies 6 are arranged in a staggered pattern to allow an efficient use of the continuous web 90. The first shell segments 61 are mounted to the second carrier plate 57 via first connection elements 53. The second shell segments 62 are mounted to the second carrier plate 57 via second connection elements 52. More particularly, the second shell segments 62 are connected to the second connection elements 52 via their respective shell biasing members 55. In this particular embodiment, the collector 5 further comprises a stop 58 for limiting the movement of the second shell segment 62 towards the first shell segment 61. More particularly, the container assembly 6 comprises a latch 68 attached to the second shell segment 62 for cooperating with said stop 58.

As is further shown in FIGS. 10A-10D, the container assemblies 6 each comprise a shuttle 7 positioned within the shell 60 for supporting the pads 91 in the stacking direction S. The cross section of the shuttle 7 corresponds or substantially corresponds to the inner cross section of the shell 60. The shuttle 7 is in abutment with both the first shell segment 61 and the second shell segment 62. The shuttle 7 is kept in place due to friction between said shuttle 7 and the abutting first shell segment 61 and second shell segment 62. The shuttle 7 is movable in the stacking direction S and along the collecting axis A when a force, large enough to overcome the frictional engagement, is applied to the shuttle 7, i.e. for example when an ejector 41 pushes a punched pad 91 into the shell 60.

As is shown in FIG. 9, the shuttle 7 comprises a first part 71 and a second part 72. The first part 71 and the second part 72 are biased away from one another by two shuttle biasing members 73, preferably springs. In this particular embodiment, the first part 71 and the second part 72 of the shuttle are biased relative to one another in the clamping direction K. The first part 71 is in abutment with the first shell segment 61 and the second part 72 is in abutment with the second shell segment 62.

As is best shown in FIGS. 10A-10D, the shell biasing member 55 exerts a first biasing force F1 on the second shell segment 62 in the clamping direction K and at the shell biasing position 66. The shuttle biasing member 73 exerts a second biasing force F2 on the second shell segment 62 in a direction opposite to the clamping direction K. Said first biasing force F1 results in a first biasing moment M1 about the shell rotation axis 63 exerted on the second shell segment 62. The second biasing force F2 results in a second biasing moment M2 about the shell rotation axis 63 exerted on the second shell segment 62. Said second biasing moment M2 is opposite to the first biasing moment M1. When the shuttle 7 is displaced along the collecting axis A towards the bottom side 64, the second biasing moment M2 decreases. Consequently, the second biasing force F2 is dependent on the position of the shuttle 7 along the collecting axis A.

Figure 10A:
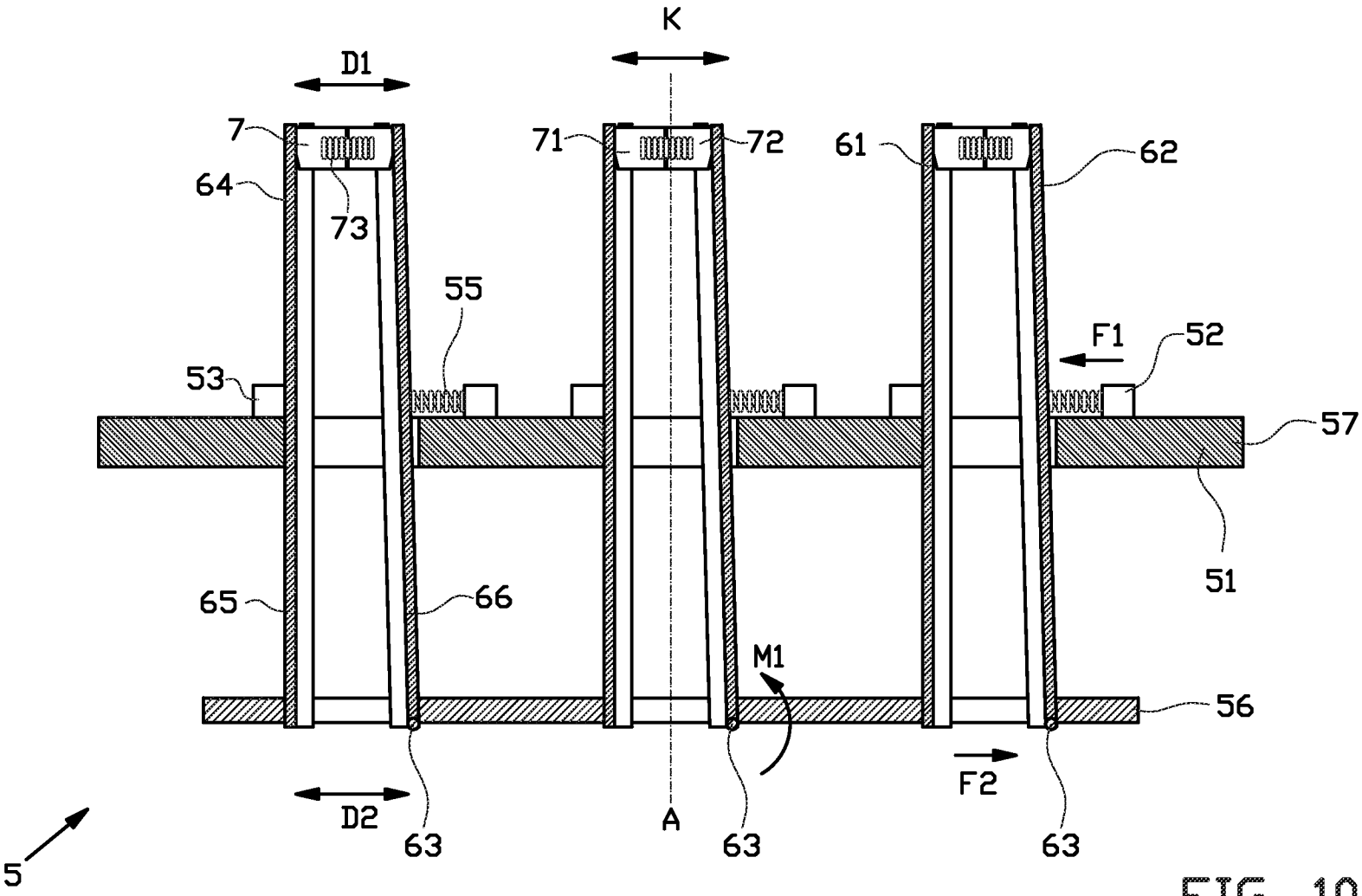
FIGS. 10A-10E show section views of a carrier assembly according to the present invention.

FIG. 10A shows the collector 5 when the shuttle 7 is positioned at or near the top side 64 of the shell 60. The container assembly 6 is in a first receiving state. In said first receiving state, the first biasing moment M1 is equal to or larger than the second biasing moment M2. Consequently, a first mutual distance D1 in the clamping direction K between the first shell segment 61 and the second shell segment 62 at the top side 64 of the shell 60 is smaller than a second mutual distance D2 in the clamping direction K between the first shell segment 61 and the second shell segment 62 at the bottom side 65 of the shell 60. In the embodiment as shown in FIG. 10A, the shell biasing member 55 and the shuttle biasing members 73 have been configured such that the first part 71 and the second part 72 of the shuttle are urged towards one another when the second shell segment 62 is in the first receiving state. Preferably, said first part 71 and second part 72 are in mutual abutment.

Figure 10B:
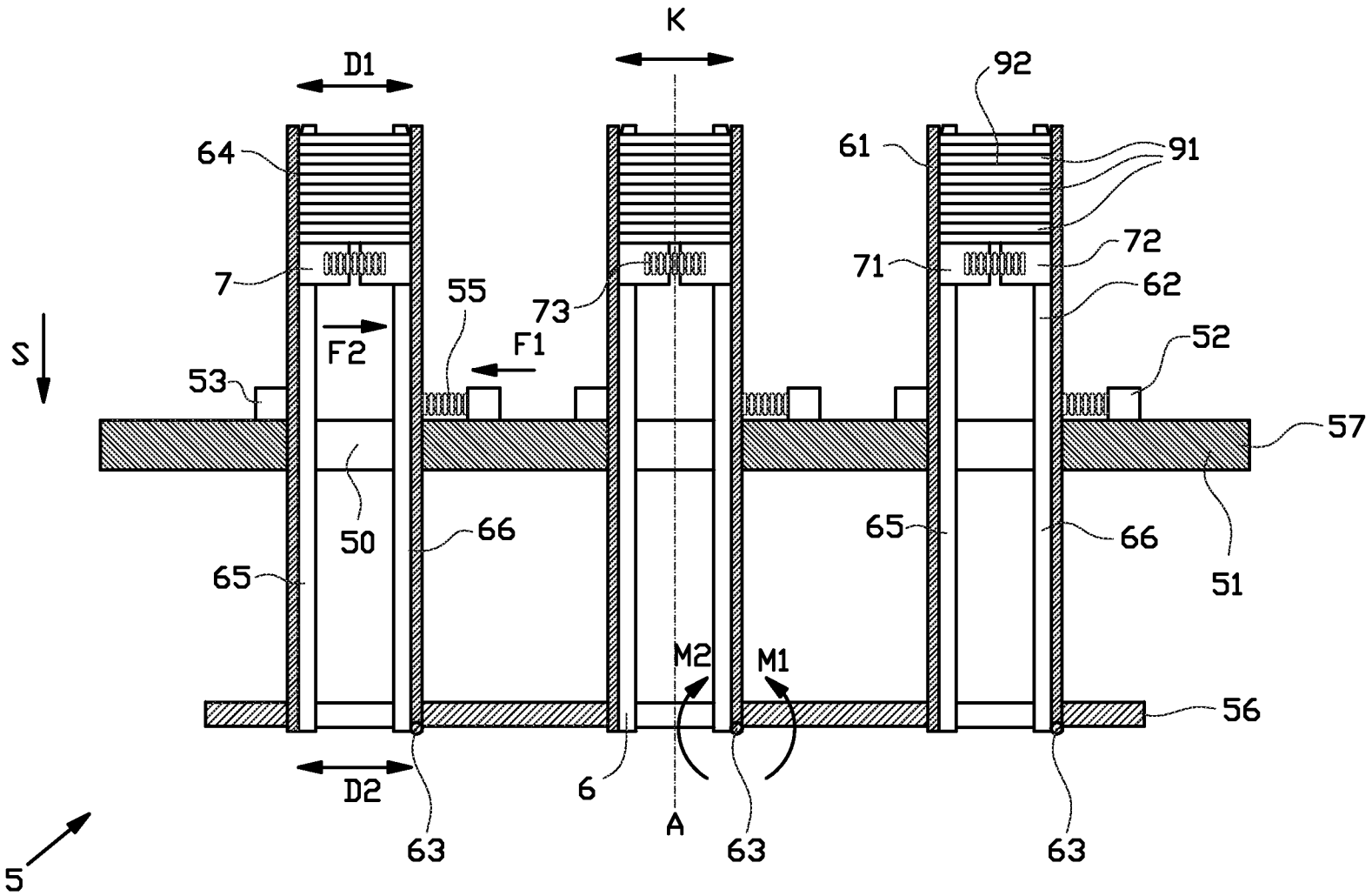

FIG. 10B shows the container assembly 6 in a second receiving state in which a plurality of the pads 91 has been received within said container assembly 6 to form a stack 92 of pads 91. Said stack 92 is supported by the shuttle 7. The stack 92 urges the second shell segment 62 away from the first shell segment 61 in the clamping direction K. In other words, the stack 92 counteracts the first biasing moment M1. Consequently, the first biasing moment M1 exerts a clamping force on the stack 92 in the clamping direction. Moreover, the first mutual distance D1 at the top side 64 of the shell 60 can adapt to the diameter of the pads 91. As the second shell segment 62 is displaced in the clamping direction K away from the first shell segment 61, the shuttle 7 extends in the clamping direction K to remain in abutment with the container assembly 6. In particular, the first part 71 and the second part 72 are urged away from one another by the second biasing force F2, such that the first part 71 remains in abutment with the first shell segment 61 and the second part 72 remains in abutment with the second shell segment 62.

Figure 10C:
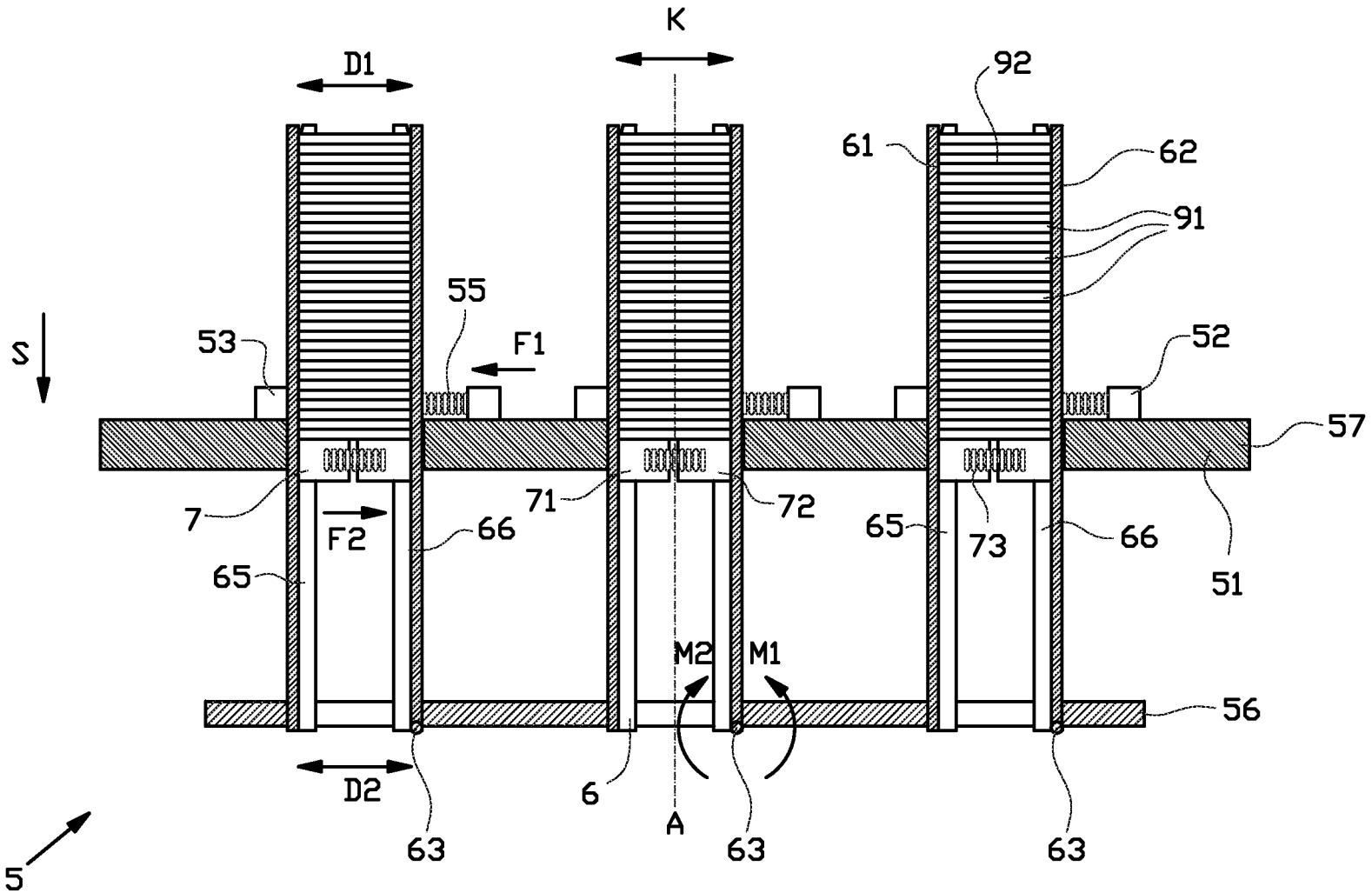

FIG. 10C shows the container assembly 6 in a third receiving state, in which the shuttle 7 is positioned between the top side 64 and the bottom side 65 of the shell 60 near the shell biasing member 55. In the third receiving state, the second biasing moment M2 has decreased as result from the shuttle 7 moving towards the shell rotation axis 63. Consequently, the clamping force on stack 92 has increased.

Figure 10D:
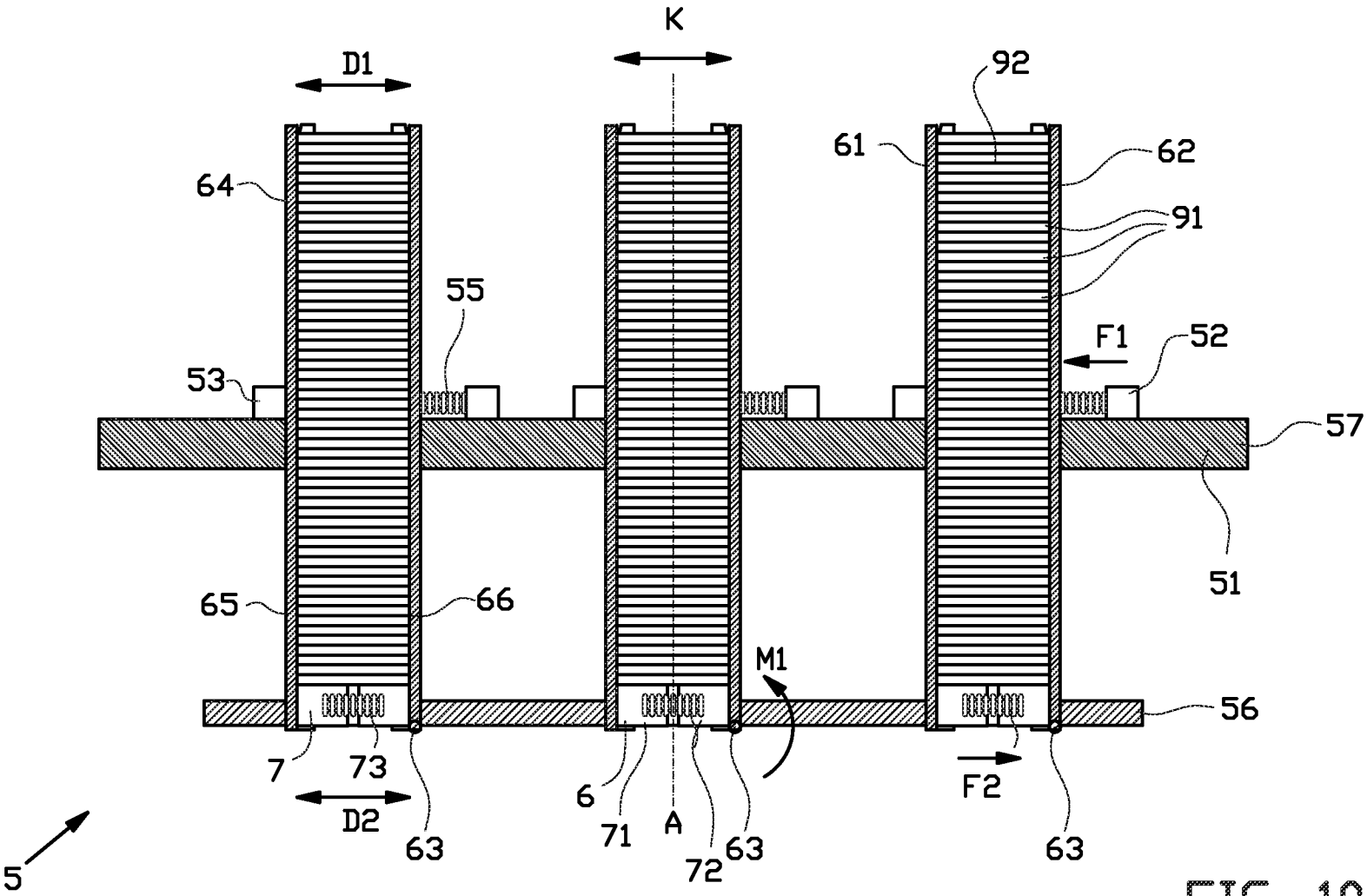

FIG. 10D shows the container assembly 6 in a fourth receiving state, in which the shuttle 7 is positioned near the bottom side 65 of the shell 60. In said third receiving state, the second biasing moment M2 has decreased further as result from the shuttle 7 moving further towards the shell rotation axis 63. Hence, the stack 92 of pads 91 is clamped in the clamping direction K with a bigger clamping force.

As is best shown in FIGS. 1-8, the punching device 1 further comprises a drive assembly 8 for driving the movements of the first die 2 and the ejector assembly 4. The drive assembly 8 comprises a rotationally driven drive shaft 80 rotatable in a rotation direction D about a drive axis B extending perpendicular to the punching direction P.

The drive assembly 8 comprises a cam wheel 81 arranged on said drive shaft 80 and co-rotational with said drive shaft 80 in the rotation direction D about the drive axis B for driving the movement of the first die 2. The cam wheel 81 has a circular cross section and is arranged off center with respect to the drive shaft 80. In other words, the cam wheel 81 acts as a crank shaft. The drive assembly 8 further comprises a crank 82 that surrounds the cam wheel 81 and extends between the cam wheel 81 and the first die 2 to convert a rotational movement of the drive shaft 80 in the rotation direction D into a translational movement of the first die 2 in the punching direction P.

The first die 2 comprises a first die frame 23 connected to the first body 21. The first die frame 23 comprises a guide rail 25 which is guided in the punching direction P by two linear guides 26 or guide shoes. Said linear guides 26 or guide shoes are arranged in line in the punching direction P. The linear guides 26 or guide shoes are arranged stationary with respect to the second die 3. The first die frame 23 further comprises a crank connection element 24 for hingedly connecting the crank 82 to the first die frame 23. Hence, the first die 3 is able to reciprocally move up and down in the punching direction P upon a rotation of the drive shaft 80.

Figure 2:
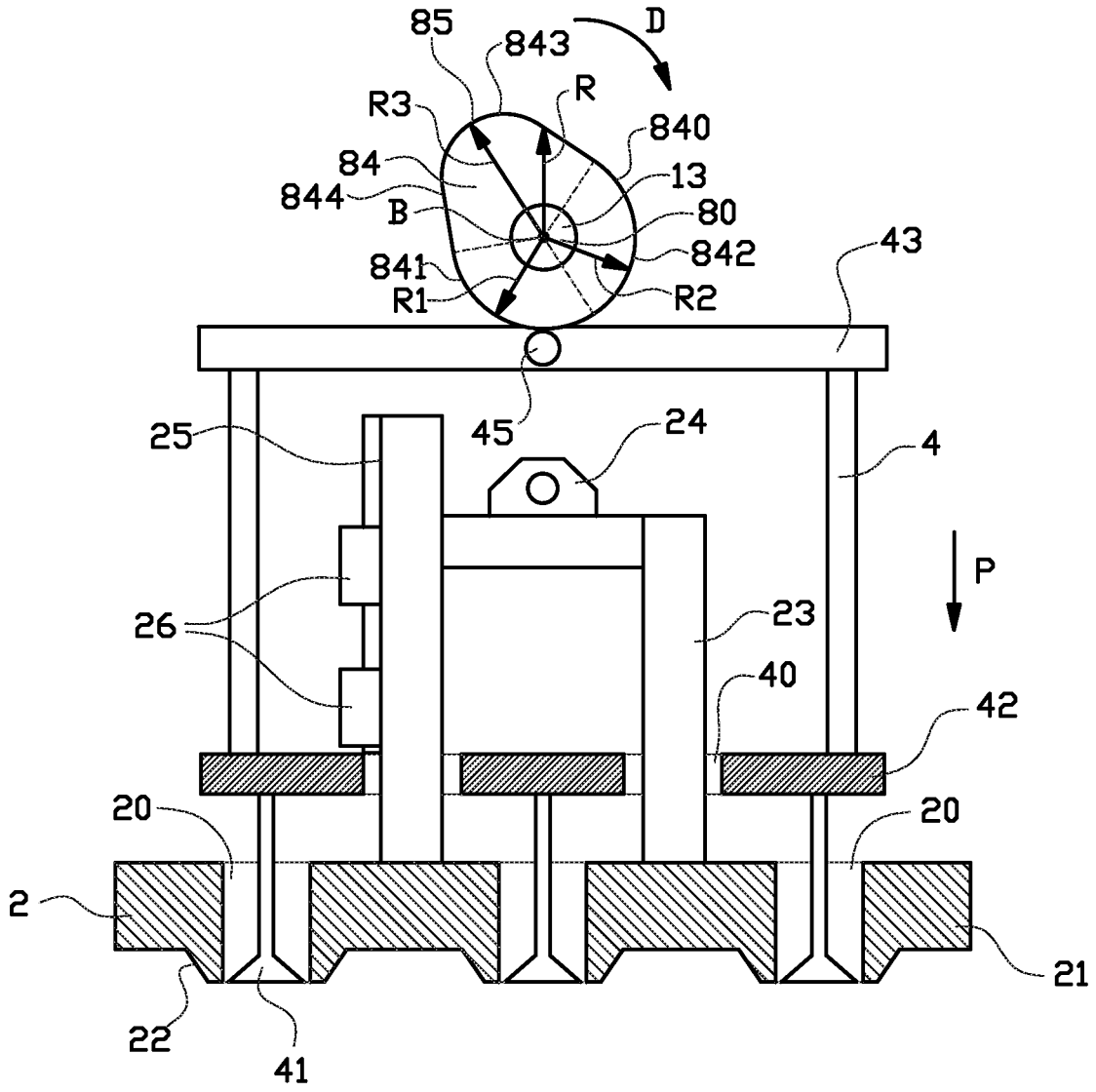
FIGS. 2, 4, 6 and 8 show the top half of the section view of FIG. 1 with the crank omitted.

As is best shown in FIGS. 2, 4, 6 and 8, the drive assembly 8 further comprises a curve wheel 84 for driving the movement of the ejector assembly 4. The curve wheel 84 is arranged on the drive shaft 80 and co-rotational with said drive shaft 80. The curve wheel 84 has a curved circumference 840 having a variable curve wheel radius R1, R2, R3 in a radial direction R perpendicular to the drive axis B. Said curve wheel radius R1, R2, R3 varies along the rotation direction D between a first radius R1, a second radius R2, larger than the first radius R1, and a third radius R3, larger than the second radius R2. As is shown in FIG. 2, a first curve 841 of the circumference 840 extends in the rotation direction D at the first radius R1 from the drive axis B. A second curve 842 of the circumference 840, adjacent or subsequent to the first curve 841 in the rotation direction D, extends in the rotation direction D at the second radius R2 from the drive axis B. A third curve 843 of the circumference 840, adjacent or subsequent to the second curve 842 in the rotation direction D, increases along the rotation direction D in the radial direction R from the second radius R2 to a curve wheel maximum 85 at the third radius R3. A fourth curve 844 extends between the third curve 843 or the curve wheel maximum 85 and the first curve 841. The fourth curve 844 decreases in the radial direction R from the third radius R3 to the first radius R1 along the rotation direction D. Preferably, the third curve 843 and the fourth curve 844 each extend over less than ninety degrees in the rotation direction D.

The ejector assembly 4 comprises an ejector frame 43 for supporting the ejectors 41. Said ejector frame 43 is supported relative to the second die 3 and biased upwards in the punching direction P. The ejector frame 43 comprises a ejector plate 42 having passage apertures 40 for enabling the first die frame 23 to extend through said ejector plate 42. The ejector assembly 4 further comprises a cam 45 connected to said ejector frame 43 and in abutment with the curve wheel 84. In other words, the cam 45 follows the circumference 840 of the curve wheel 84.

A method for punching pads will now be described using FIGS. 1-8, 10A-10D and 11.

Figure 11:
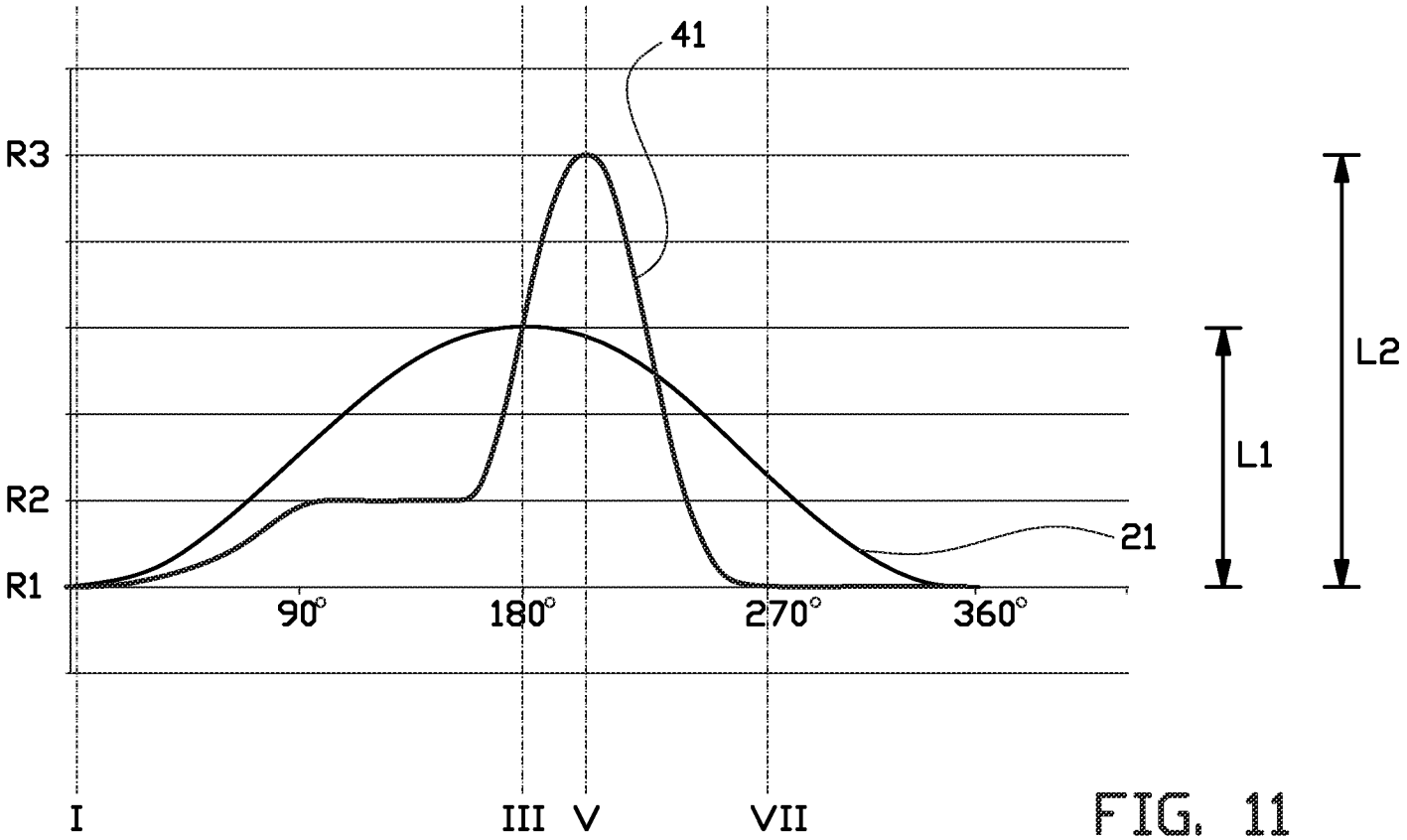
FIG. 11 shows a graph of the strokes of a first die and an ejector of the punching member.

FIG. 11 shows the strokes of the first body 21 of the first die 2 and the ejectors 41 of the ejector assembly 4, respectively, as a function of the rotation of the drive shaft 80 in the rotation direction D about the drive axis B.

The mode as shown in FIGS. 1 and 2 corresponds to the point I in FIG. 11. In this mode, the drive shaft 80 is in a reference angular position or idle angular position. As is shown in FIG. 1, the cam wheel 81 is pointed upwards and the crank 82 is placed in its uppermost position. The cam 45 is in abutment with the first curve 841 of the curve wheel 84 such that the ejectors 41 are in their uppermost position as well.

Figure 3:
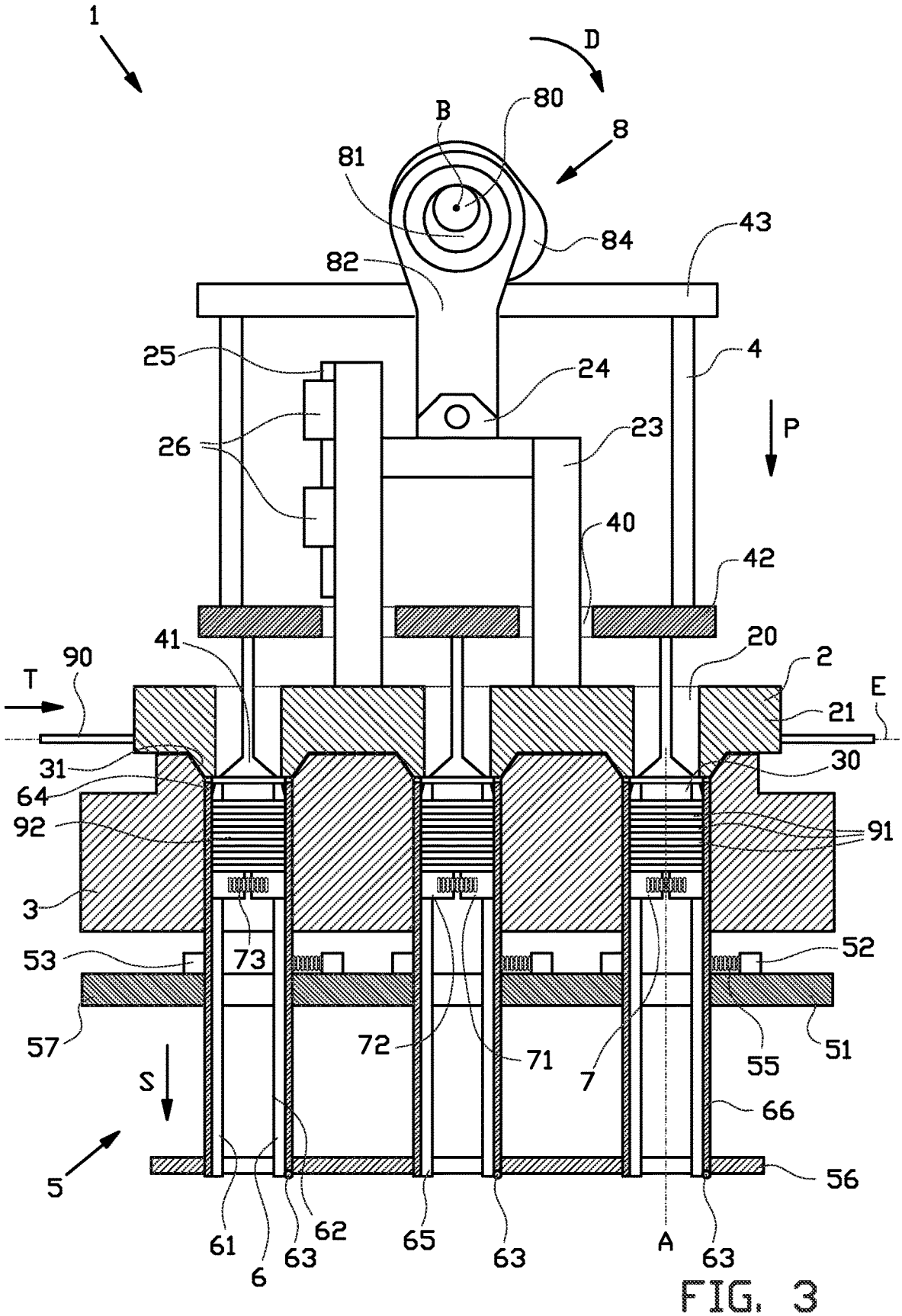
Figure 4:
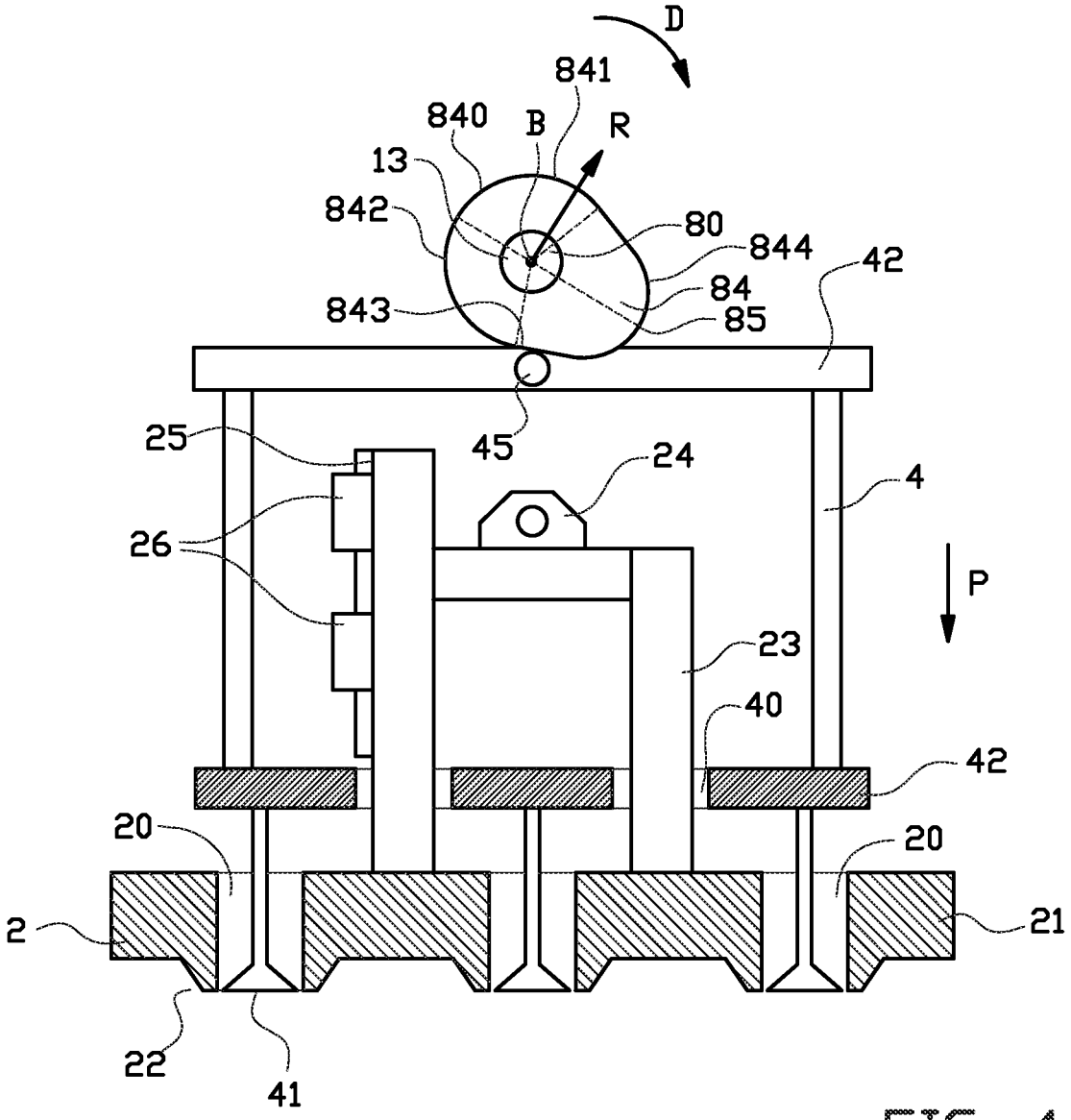

The mode as shown in FIGS. 3 and 4 corresponds to the point III in FIG. 11. The drive shaft 80 has been rotated clockwise in the rotation direction D over one-hundred-and-eighty degrees. As is shown in FIG. 3, the cam wheel 81 is pointed downwards and the crank 82 has been moved into its lowermost position. The first die 2 has been moved towards the second die 3 for clamping the web 90 between said first die 2 and second die 3. In particular, the first die 2 has been moved in the punching direction P over a distance equal to a maximum die stroke L1. The first cutting edges 21 of the first die 2 have been moved along the second cutting edges 31 of the second die 3 in order to punch the pads 91 from the web 90 through sheering contact of said first cutting edges 21 and second cutting edges 31. The ejectors 41 have been moved into contact with the web 90.

As is best seen in FIG. 4, the curve wheel 84 has been rotated such that the cam 45 is in abutment with the third curve 843 of the curve wheel 84. In particular, the cam 45 abuts the circumference 840 of the curve wheel 84 at a point where third curve 843 extends along the rotation direction D at a curve wheel radius between the second radius R2 and the third radius R3. Hence, the ejectors 41 have been moved in the punching direction P over a distance equal to the difference between the respective curve wheel radius and the first radius R1. In this particular embodiment, the ejectors 41 have been moved in the punching direction P over a distance equal to the maximum die stroke L1.

Figure 5:
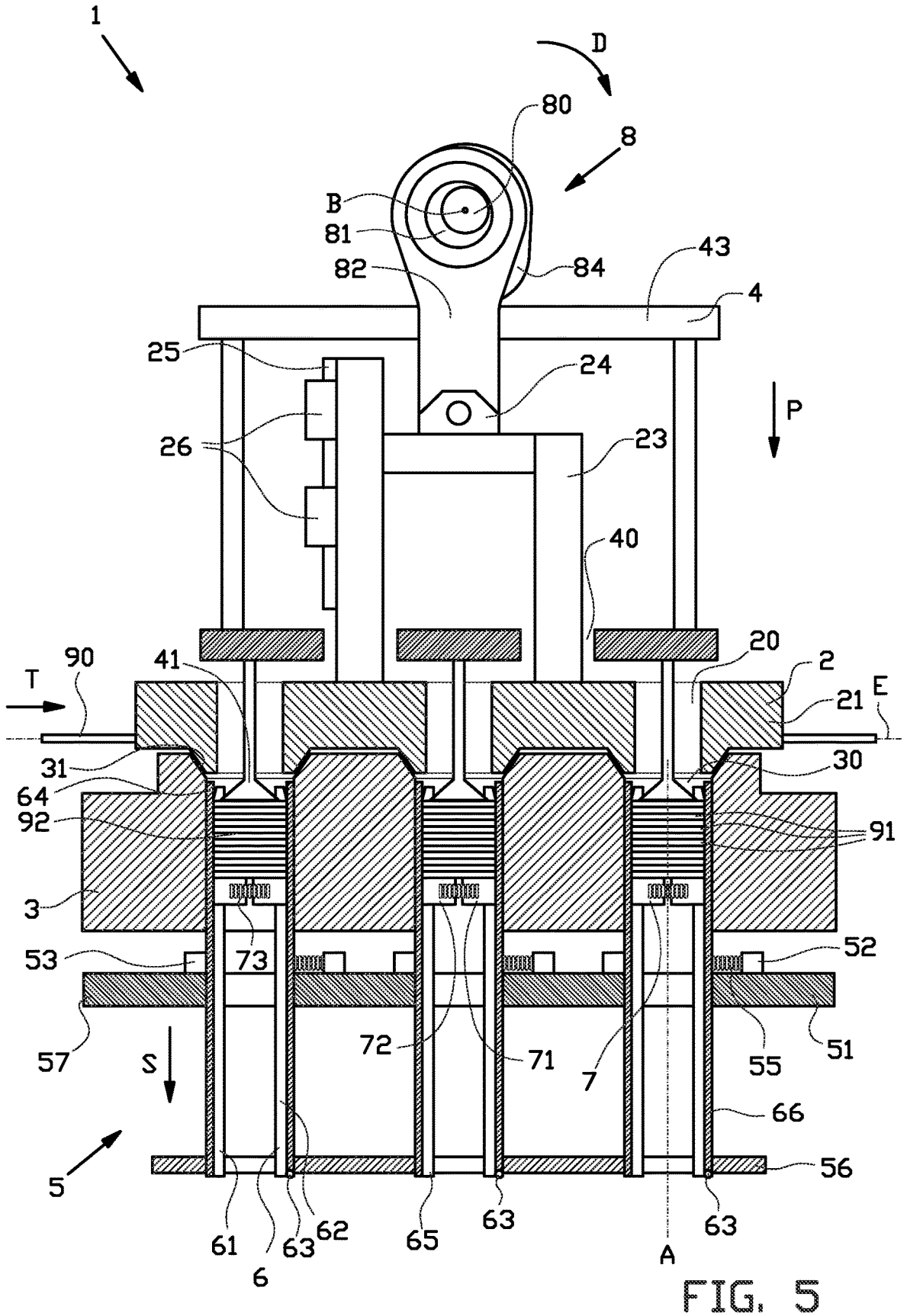
Figure 6:
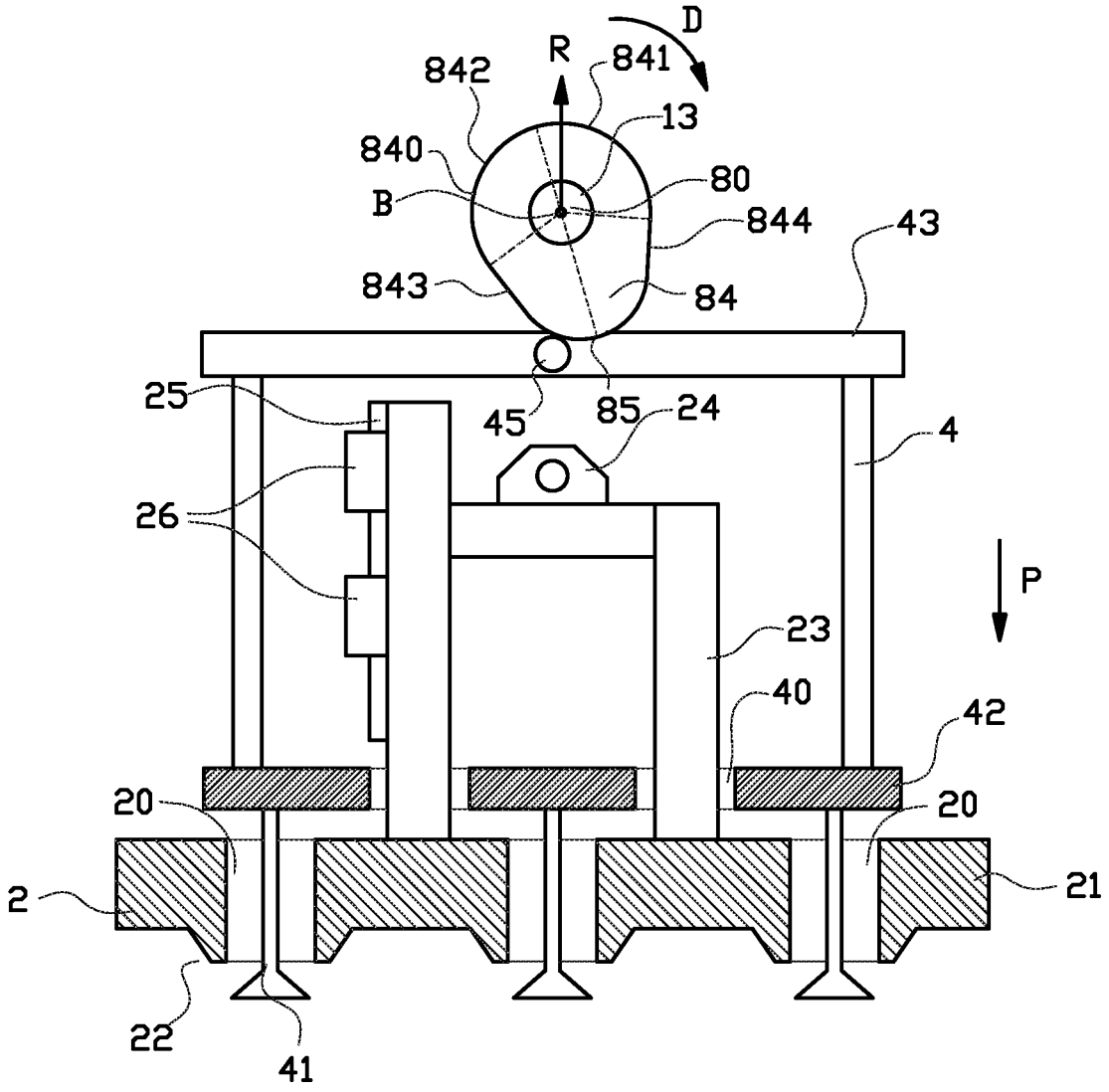

The mode as shown in FIGS. 5 and 6 corresponds to the point V in FIG. 11. The drive shaft 80 has been rotated clockwise over approximately two-hundred degrees. As is shown in FIG. 5, the cam wheel 81 has been rotated past its lowermost point. Consequently, the crank 82 and the associated first die 2 have been moved upward in the punching direction P. The curve wheel 84 has been rotated such that curve wheel maximum 85 points downwards and the ejector assembly 4 has been moved in its lowermost position. Accordingly, the ejectors 41 have urged the punched pads 91 into the corresponding container assemblies 6. In particular, the ejectors 41 have been moved over a distance equal to a maximum ejector stroke L2 larger than the maximum die stroke L1. Said maximum ejector stroke L2 is equal to the difference between the third radius R3 and the first radius R1.

Figure 7:
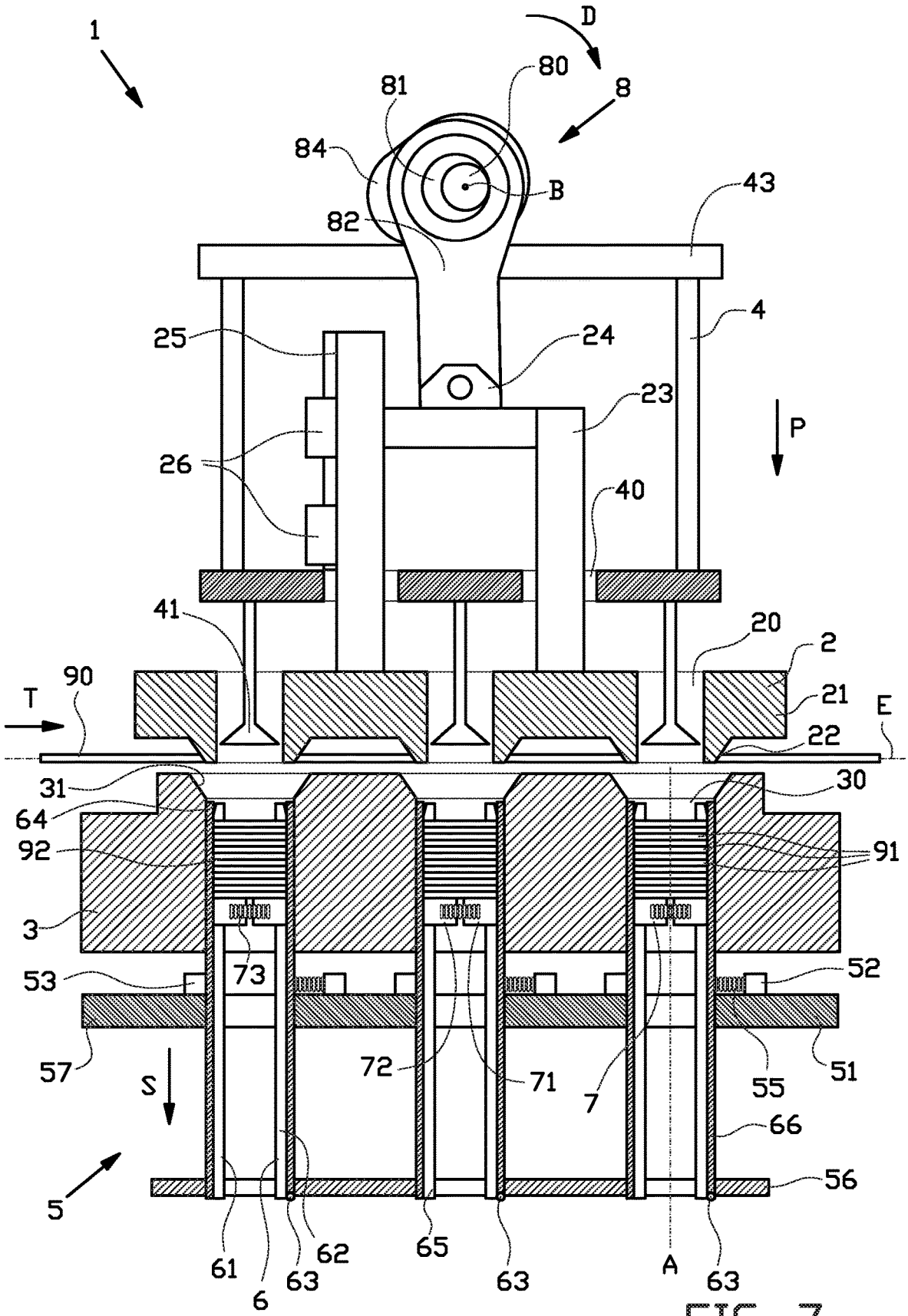
Figure 8:
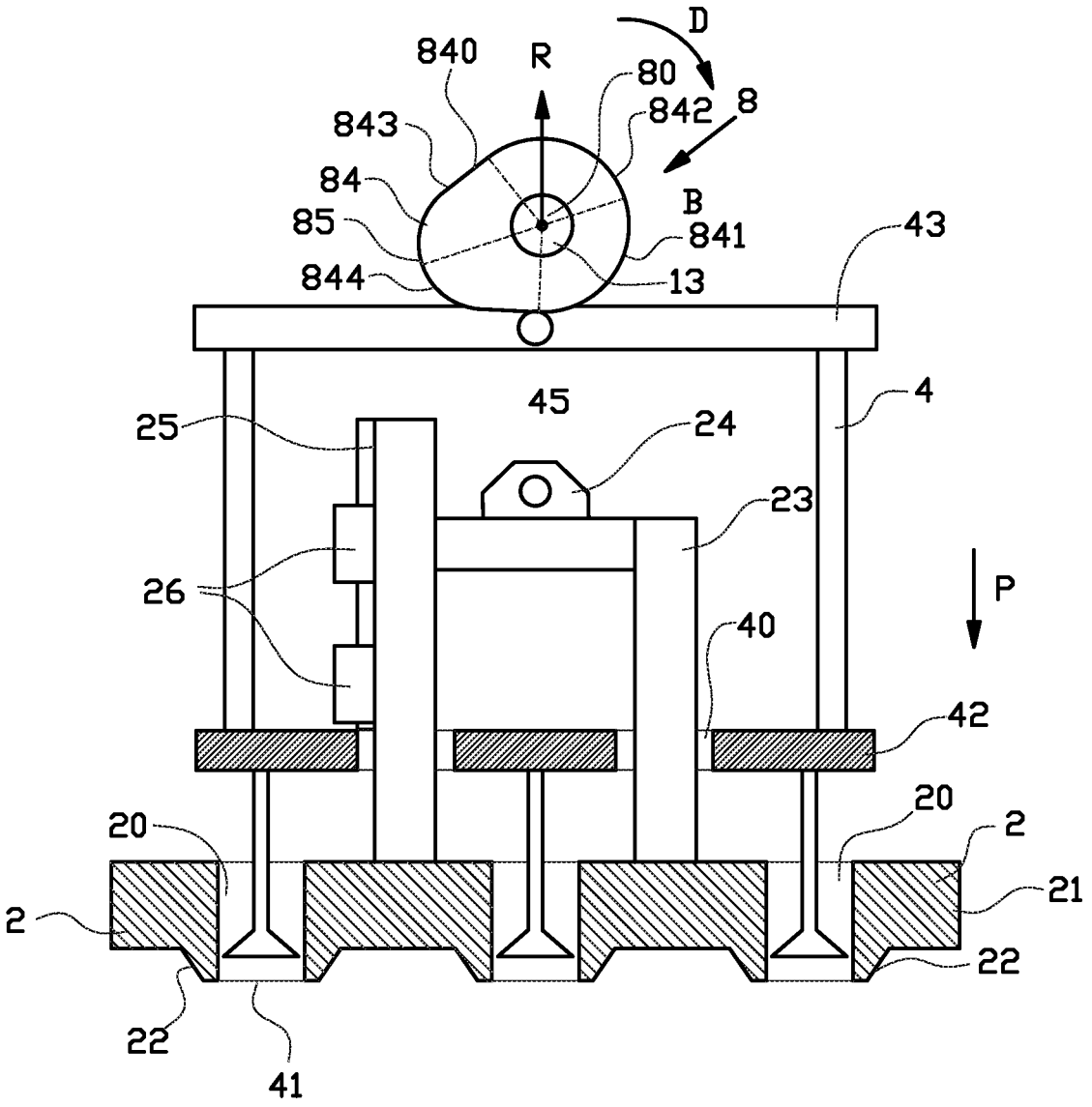

The mode as shown in FIGS. 7 and 8 corresponds to the point VII in FIG. 11. The drive shaft 80 has been rotated clockwise over two-hundred-and-seventy degrees. As is best shown in FIG. 8, the cam wheel 84 has been rotated such that the cam 45 abuts the first curve 841. Consequently, the ejector assembly 4 has been moved back to its idle position.

Figure 10E:
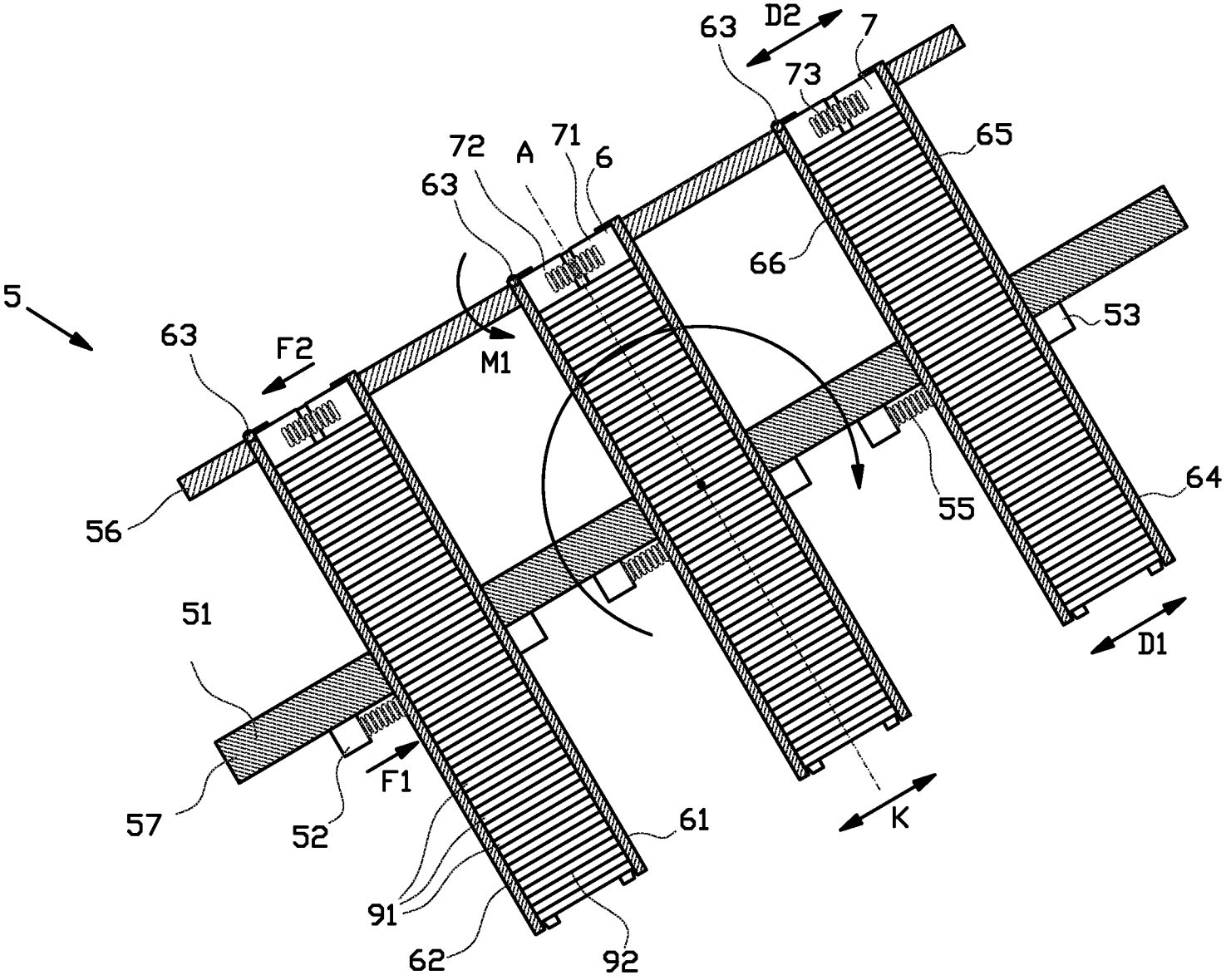

As is shown in FIG. 10E, the method for punching the pads 91 further comprises the step of removing the collector 5 from the punching device 1. During said removal, the collector 5 may be rotated or inverted with respect to the direction of gravitation. Preferably, the collector 5 is removed from the punching device 1, when a predetermined number of pads 91 has been collected in each shell 60. The collector 5 may be removed from the punching device 1 and/or rotated or inverted by a manipulator. The collected pads 91 are stacked in the stacking direction S forming stacks 92. The second shell segment 62 is biased towards the first shell segment 61, such that the shuttle 7 and at least a top part of the stack 92 of pads 91, i.e. a portion of the stack 92 closest to the top side 64 of the shell 60, is clamped between said first shell segment 61 and second shell segment 62. Consequently, the pads 91 are retained in the shell 60 independent of the orientation of said shell 60, e.g. when the top side 64 is directed downwards.

In a next step, the pads 91 are removed from the shell 60 by urging the shuttle 7 in the stacking direction S towards the top side 64 of the shell 60. Said next step may for example be a step of packing the pads 91.

Figure 12:
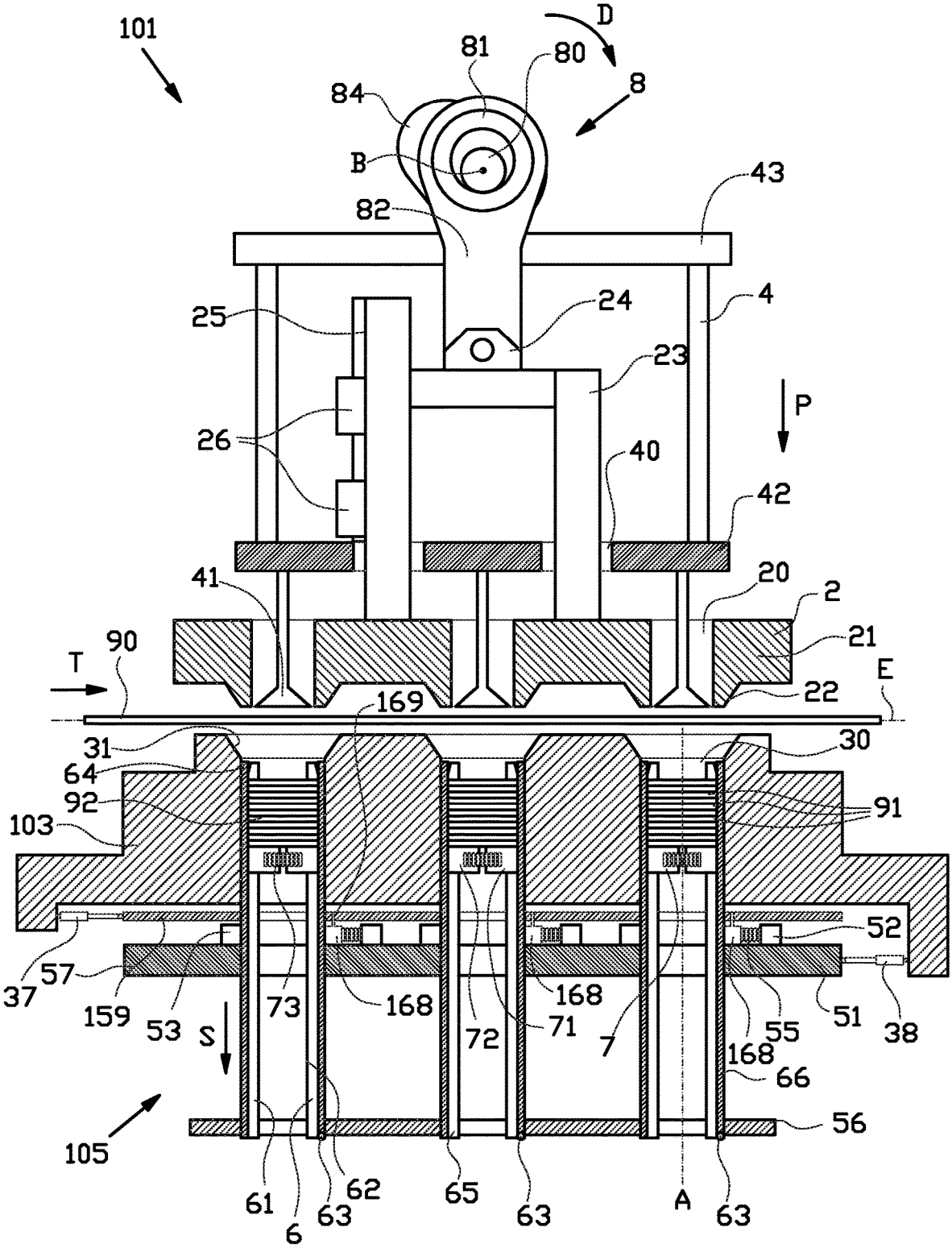
FIG. 12 shows a section view of an alternative punching device comprising an alternative carrier assembly.

FIG. 12 shows an alternative punching device 101 according to the present invention. The alternative punching device 101 differs from the previously discussed punching device 1 in that it comprises an alternative second die 103 and an alternative collector 105.

Figure 13A:
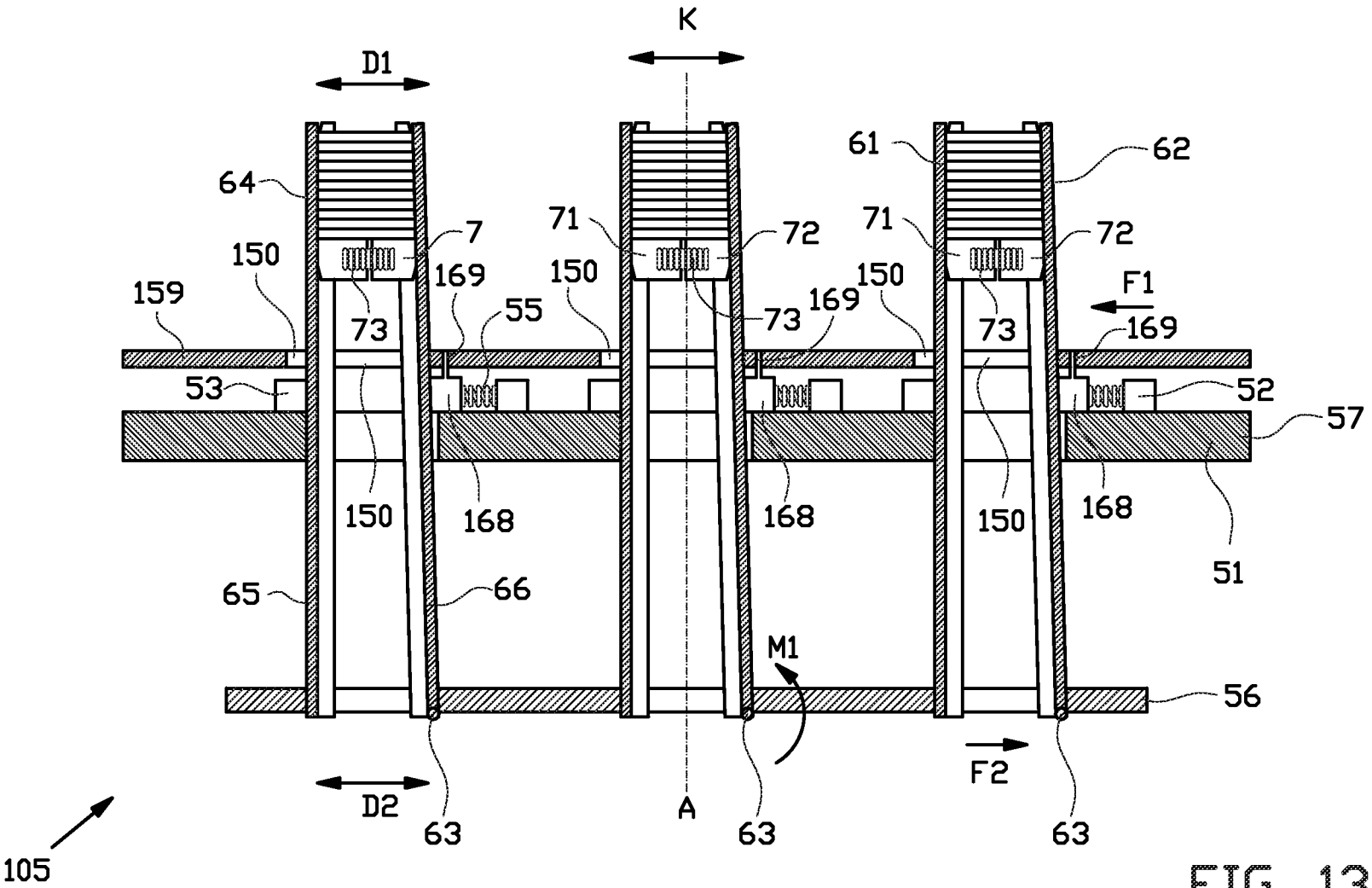
FIGS. 13A and 13B show section views of the alternative carrier assembly.
Figure 13B:
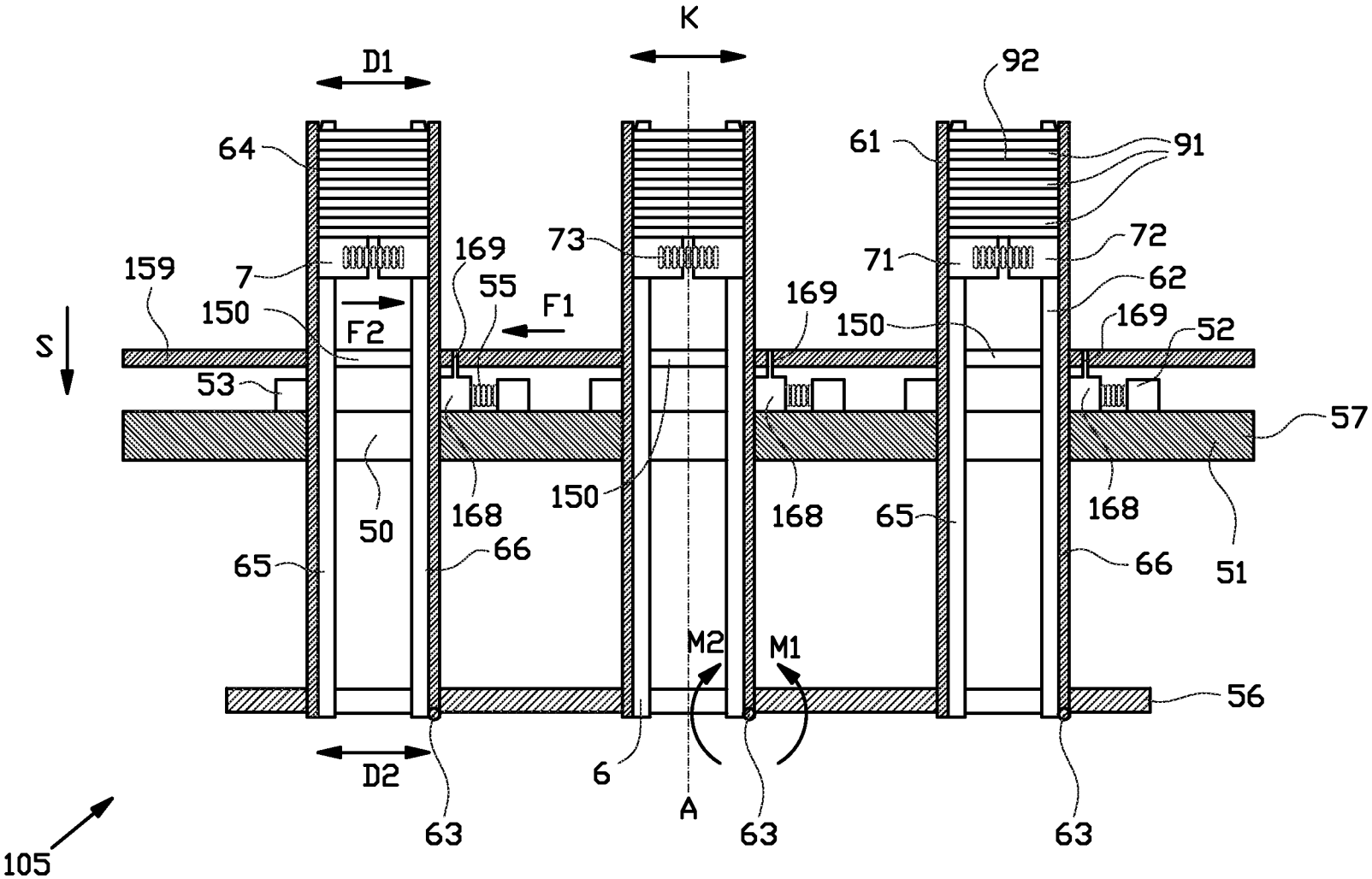

As is shown in FIGS. 12, 13A and 13B, the collector 105 differs from the previously discussed collector 5 in that it further comprises an opener plate 159 for displacing the second shell segments 62 with respect to the first shell segments 61. The opener plate 159 is movable in a direction parallel to the first carrier plate 56. The opener plate 159 comprises apertures 150 for receiving the container assemblies 6.

In the embodiment as shown, the opener plate 159 is connected to the second shell segments 62 via the respective latches 168 thereof. In particular, the latches 168 comprise a connection member 169, such as a pin, for connecting the latches 168 to the opener plate 159.

As can be seen in FIG. 12, the alternative second die 103 comprises a opener plate cylinder 37 for operating the movement of the opener plate 159 in a direction parallel to the first carrier plate 56. The alternative second die 103 further comprises a counter cylinder 38 for abutting the second carrier plate 57. Said counter cylinder 38 is arranged to prevent a shifting of the collector 105 relative to the second die 103 due to the operating of the opener plate 159.

As is best shown in FIGS. 13A and 13B, the opener plate 159 is arranged for selectively opening the container assemblies 6, i.e. by moving the second shell segment 62 away from the first shell segment 61, when the ejector assembly 4 urges the pads 91 in said container assemblies 6. When the pads 91 have been pushed into the respective shell assemblies 6, the opener plate 159 may be displaced in the opposite direction to allow the second shell segments 62 to move towards the first shell segments 91 for clamping the stacks 92 of pads 91 accumulated in the respective container assemblies 6. The opening of the container assemblies 6 may facilitate the insertion of the pads 91 in said container assemblies 6. Moreover, the stroke of the ejector assembly 4 may be further reduced, thus reducing cycle times as well.

In summary, the invention relates to a container assembly for collecting pads, such as cosmetic pads or medical pads, wherein the container assembly comprises an elongate shell extending along a collecting axis parallel to a stacking direction and in a circumferential direction about the collecting axis, wherein the shell comprises a top side, a bottom side opposite to said top side in the stacking direction, wherein the shell is open at said top side for receiving the pads in said stacking direction and along said collecting axis, wherein the shell comprises a first shell segment and a second shell segment extending along said collecting axis between the top side and the bottom side and movable relative to one another in a clamping direction transverse to the stacking direction, wherein the second shell segment is biased relative to and towards the first shell segment in said clamping direction.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. A container assembly for collecting pads in a stacking direction, wherein the container assembly comprises an elongate shell extending along a collecting axis parallel to the stacking direction and extending in a circumferential direction about the collecting axis, wherein the shell comprises a top side and a bottom side opposite to said top side in the stacking direction, wherein the shell is open at said top side for receiving the pads in said stacking direction and along said collecting axis, wherein the shell comprises a first shell segment and a second shell segment extending along said collecting axis between the top side and the bottom side and movable relative to one another in a clamping direction transverse to the stacking direction, wherein the second shell segment is biased relative to the first shell segment to move towards said first shell segment in the clamping direction, wherein the container assembly further comprises a shuttle to be positioned within the shell for supporting the pads received therein, wherein the shuttle is configured to abut the first shell segment and the second shell segment of the elongate shell, and wherein the shuttle is movable in the stacking direction along the collecting axis.

2. The container assembly according to claim 1, wherein the second shell segment is rotatable about a shell rotation axis extending perpendicular to the stacking direction and the clamping direction.

3. The container assembly according to claim 2, wherein the shell rotation axis is located at the bottom side of the shell.

4. The container assembly according to claim 3, wherein the container comprises a shell biasing member for biasing the second shell segment towards the first shell segment, wherein the shell biasing member acts on the second shell segment at a shell biasing position spaced apart from the bottom side of the shell.

5. The container assembly according to claim 1, wherein the shuttle comprises a first part and a second part, wherein the first part and the second part are biased away from one another and towards the first shell segment and the second shell segment of the container assembly, respectively.

6. The container assembly according to claim 5, wherein the second shell segment is rotatable about a shell rotation axis extending perpendicular to the stacking direction and the clamping direction and located at the bottom side of the shell, wherein the second shell segment is biased towards the first shell segment by a first biasing moment about said shell rotation axis, wherein the first part and the second part of the shuttle are biased towards the first shell segment and the second shell segment, respectively, with a biasing force such that a second biasing moment, opposite to the first biasing moment, is exerted on the second shell segment, wherein the second biasing moment is dependent on the position of the shuttle along the collecting axis relative to the shell rotation axis.

7. The container assembly according to claim 6, wherein, the second biasing moment is smaller than the first biasing moment.

8. The container assembly according to claim 6, wherein, when the shuttle is moved from the top side of the shell towards the bottom side of the shell, the second biasing moment decreases.

9. The container assembly according to claim 6, wherein, when the shuttle is positioned at or near the top side of the shell, a first mutual distance in the clamping direction between the first shell segment and the second shell segment at the top side of the shell is smaller than a second mutual distance in the clamping direction between the first shell segment and the second shell segment at the bottom side of the shell.

10. The container assembly according to claim 6, wherein, when the shuttle is positioned at the bottom side of the shell, a first mutual distance in the clamping direction between the first shell segment and the second shell segment at the top side of the shell is smaller than a second mutual distance in the clamping direction between the first shell segment and the second shell segment at the bottom side of the shell.

11. The container assembly according to claim 1, wherein the shell has a tubular shape.

12. A collector for receiving and collecting pads from a punching device, wherein the collector comprises a carrier frame and a container assembly according to claim 1, wherein said container assembly is mounted to said carrier frame, wherein the second shell segment is movable relative to said carrier frame and biased relative to said carrier frame to move towards the first shell segment.

13. The collector according to claim 12, wherein the carrier frame comprises a first carrier plate facing in the stacking direction and a second carrier plate parallel to said first carrier plate and at a distance from said first carrier plate in the stacking direction, wherein the first shell segment and the second shell segment are, at the bottom side of the shell, mounted to the first carrier plate, and wherein the first shell segment and the second shell segment are, at a center region of the shell, mounted to said second carrier plate.

14. The collector according to claim 13, wherein the second shell segment is rotatable about a shell rotation axis located at the bottom side of the shell and extending perpendicular to the stacking direction and the clamping direction, wherein the container comprises a shell biasing member for biasing the second shell segment towards the first shell segment, wherein the shell biasing member acts on the second shell segment at a shell biasing position spaced apart from the bottom side of the shell, wherein the second shell segment is hingedly connected to the first carrier plate, and wherein the second shell segment is connected to the second carrier plate via said shell biasing member for biasing the second shell segment towards the first shell segment.

15. The collector according to claim 14, wherein the collector further comprises a stop for limiting the movement of the second shell segment towards the first shell segment.

16. The collector according to claim 13, wherein the first shell segment is rigidly connected to the first carrier plate or the second carrier plate.

17. The collector according to claim 13, wherein the collector comprises an opener plate which is connected to the second shell segment for selectively moving said second shell segment relative to the first shell segment, wherein the opener plate is movable in a direction parallel to the first carrier plate.

18. A punching device for manufacturing pads from a continuous web, the punching device comprising a collector according to claim 12, wherein the punching device further comprises a first die and a second die opposite to the first die in a punching direction, wherein the first die and the second die are movable relative to each other in said punching direction for punching the pads, wherein the first die comprises a first body and an ejector aperture extending through said first body in the punching direction, wherein the second die comprises a second body and a receiving aperture extending through said second body in the punching direction for receiving the punched pads, wherein the punching device further comprises an ejector which is movable in the punching direction relative to the first die through the ejector aperture and towards the receiving aperture of the second die for ejecting the punched pads into the receiving aperture of the second die, wherein the collector is mounted relative to the second die, such that the container assembly extends into the receiving aperture for receiving the punched pads at said receiving aperture.

19. The punching device according to claim 18, wherein the second body has a cutting edge extending circumferentially about said receiving aperture and facing the first die in the punching direction, and wherein the container assembly extends up to a distance of less than ten millimeters of said cutting edge in the punching direction.

20. The punching device according to claim 18, wherein the receiving aperture is dimensioned for accommodating the container assembly with the first shell segment and the second shell segment extending parallel to each other.

21. A method for collecting pads, such as cosmetic pads or medical pads, using a container assembly according to claim 1, wherein the method comprises the step of receiving a pad through the open top side of the shell, wherein, the first shell segment and the second shell segment are biased towards one another in the clamping direction.

22. The method for collecting pads according to claim 21, wherein the second shell segment is pivotable towards first shell segment about a shell rotation axis at the bottom side of the shell and perpendicular to the stacking direction and the clamping direction, wherein the method further comprises the steps of:

providing a shuttle in the shell near the top side of said shell such that said shuttle is in abutment with both the first shell segment and the second shell segment, the shuttle comprising a first part and a second part, wherein the first part and the second part are biased away from one another and towards the first shell segment and the second shell segment of the container assembly, respectively, to exert a shell biasing moment on the second shell segment;

urging said pad in the stacking direction into a position in which the pad is supported by the shuttle in said stacking direction; and urging the shuttle and the pad supported thereon towards the bottom side of the shell, wherein, when the shuttle is urged towards the bottom side of the shell, the shell biasing moment exerted by the shuttle on the second shell segment decreases.

23. The method according to claim 21, wherein the method comprises a step in which the top side of the container assembly is directed downwards, wherein the pads received in the container assembly are retained in the container assembly during said step.

* * * * *